US012196532B2

(12) United States Patent
Cohen

(10) Patent No.: US 12,196,532 B2
(45) Date of Patent: Jan. 14, 2025

(54) APPARATUS AND METHOD FOR FOCUSING OF EXPLOSIONS

(71) Applicant: David Cohen, Herzliya (IL)

(72) Inventor: David Cohen, Herzliya (IL)

( * ) Notice: Subject to any disclaimer, the term of this patent is extended or adjusted under 35 U.S.C. 154(b) by 0 days.

(21) Appl. No.: 17/277,504

(22) PCT Filed: Sep. 19, 2019

(86) PCT No.: PCT/IL2019/051040
§ 371 (c)(1),
(2) Date: Mar. 18, 2021

(87) PCT Pub. No.: WO2020/058978
PCT Pub. Date: Mar. 26, 2020

(65) Prior Publication Data

US 2022/0034636 A1 Feb. 3, 2022

(30) Foreign Application Priority Data

Sep. 20, 2018 (IL) ..... 261899

(51) Int. Cl.
*F42B 12/10* (2006.01)

(52) U.S. Cl.
CPC ..... *F42B 12/10* (2013.01)

(58) Field of Classification Search
CPC .. F42B 12/10; F42B 1/032; F42B 1/02; F42B 1/024; F42B 1/028; F42B 1/036
USPC ..... 102/476, 475
See application file for complete search history.

(56) References Cited

U.S. PATENT DOCUMENTS 3,013,491 A * 12/1961 Poulter ..... F42B 12/14 102/318
3,100,445 A 8/1963 Poulter
3,347,164 A * 10/1967 Baks et al. ..... F42B 3/08 102/318
3,451,339 A * 6/1969 Precoul ..... F42C 9/12 102/476
4,598,775 A * 7/1986 Vann ..... E21B 43/117 175/4.6
4,672,896 A * 6/1987 Precoul ..... F42B 1/028 102/476
4,753,170 A * 6/1988 Regalbuto ..... F42D 1/04 102/305
5,505,135 A * 4/1996 Fritz ..... F42B 3/28 102/307
5,785,130 A * 7/1998 Wesson ..... E21B 43/1185 175/4.6

(Continued)

FOREIGN PATENT DOCUMENTS

CH 329766 5/1958
FR 1036037 9/1953

(Continued)

OTHER PUBLICATIONS

Office Action Dated Jan. 19, 2022 From the Israel Patent Office Re. Application No. 261899. (4 Pages).

(Continued)

*Primary Examiner* — John Cooper

(57) ABSTRACT

Device for producing focused explosions, comprises a rigid outer shell, an explosive filling, the explosive filling comprising a plurality of inwardly extending hollows; and a gap defined between the explosive filling and the rigid outer shell.

24 Claims, 22 Drawing Sheets

(56) References Cited

U.S. PATENT DOCUMENTS

| | | | | |
|---|---|---|---|---|
| 6,494,139 | B1 * | 12/2002 | Powell | F42B 1/02 175/4.6 |
| 10,443,361 | B2 * | 10/2019 | Sites | E21B 43/117 |
| 2002/0195017 | A1 | 12/2002 | Priimak | |
| 2010/0139515 | A1 * | 6/2010 | King | F42B 1/024 86/20.1 |
| 2018/0274342 | A1 * | 9/2018 | Sites | F42B 3/22 |
| 2018/0306010 | A1 * | 10/2018 | Von Kaenel | E21B 43/117 |
| 2019/0309606 | A1 * | 10/2019 | Loehken | E21B 43/119 |
| 2021/0131236 | A1 * | 5/2021 | MacGillivray | E21B 43/117 |

FOREIGN PATENT DOCUMENTS

| | | |
|---|---|---|
| FR | 1328393 | 5/1963 |
| FR | 2588950 | 4/1987 |

OTHER PUBLICATIONS

International Preliminary Report on Patentability Dated Jan. 26, 2021 From the International Preliminary Examining Authority Re. Application No. PCT/IL2019/051040. (16 Pages).

International Search Report and the Written Opinion Dated Dec. 25, 2019 From the International Searching Authority Re. Application No. PCT/IL2019/051040. (11 Pages).

Office Action Dated Apr. 25, 2023 From the Israel Patent Office Re. Application No. 272906. (3 Pages).

Supplementary European Search Report and the European Search Opinion Dated Oct. 12, 2022 From the European Patent Office Re. Application No. 19863785.2. (7 Pages).

* cited by examiner

APPARATUS AND METHOD FOR FOCUSING OF EXPLOSIONS

RELATED APPLICATIONS

This application is a National Phase of PCT Patent Application No. PCT/IL2019/051040 having International filing date of Sep. 19, 2019, which claims the benefit of priority of Israel Patent Application No. 261899 filed on Sep. 20, 2018. The contents of the above applications are all incorporated by reference as if fully set forth herein in their entirety.

FIELD AND BACKGROUND OF THE INVENTION

The present invention relates to a device for focusing of explosions and a method of manufacturing the same.

In general, in trying to defeat incoming ordnance or anything resulting from an explosion or indeed any high speed object, it is well-known to use counter-explosions.

The counter explosion can yield fragments but these may not be fast enough or directional enough or have enough kinetic energy to interact with the incoming threat.

The present embodiments attempt to address the issue and provide a counter-ordnance device that is more effective.

SUMMARY OF THE INVENTION

The present embodiments use a pattern of shaped charges and a rigid outer cover with or without a gap whose size is selected to partly or fully allow HEAT jet formation. The jet then dictates the size, speed and scatter pattern, including trajectory, of the fragments formed when the HEAT jet formed reaches the rigid outer cover. A planned design of the explosive device may control the parameters of the explosion and direct a desired directional yield that can be designed for the given threat. The device may provide multiple explosion directions that may be predetermined and all based on a single device with a single detonation point, so that the explosions are simultaneous. The fragments produced simultaneously in the different directions may have different speeds and different sizes.

According to an aspect of some embodiments of the present invention there is provided a device for producing focused explosions, and generating very high speed fragments comprising: a rigid outer shell;

an explosive filling, the explosive filling comprising a plurality of inwardly extending hollows; and a gap being defined between the explosive filling and the rigid outer shell.

In embodiments, the inwardly extending hollows are symmetrical along an axis extending into the explosive filling, and/or are cone-shaped.

In embodiments, the inwardly extending hollows are symmetrical along an angular axis extending into the explosive filling, and/or are cone-shaped.

In embodiments, the inwardly-extending hollows have bases at the surface of the explosive filling, each base having a respective radius, and the gap is less than twice a size of the largest of the respective radii.

In embodiments, the gap is larger than half the size of the largest radius, or larger than the size of the largest radius, or larger than one and a half times the size of the largest radius.

In embodiments, the inwardly-extending hollows have bases at the surface of the explosive filling, each base having a respective radius, wherein the gap is at least twice a size of the largest of the respective radii.

In embodiments, the explosive filling is covered with an outer coating, the coating extending into the inwardly extending hollows.

In embodiments, the outer coating comprises electroplating. Electroplating may be of metals, including alloys.

In embodiments, the outer coating comprises copper and aluminum and alloys.

In embodiments, the rigid outer shell comprises metal or ceramics, or particularly aluminum.

Embodiments may include a hollow container for holding the explosive filling inside the gap.

In embodiments, the hollow container comprises openings.

In embodiments, at least some of the openings comprise stepped edges.

In embodiments, the openings are of different sizes.

Cones may then be inserted into the openings.

In embodiments, the hollow container comprises cone-shaped intrusions.

In embodiments, the cones intrude into the explosive filling to form a shaped charge.

In embodiments, the rigid outer shell is grooved.

Embodiments may comprise a detonation point, the detonation point being equidistant from an apex of each one of the hollows. Alternatively or additionally the detonation point may be aligned with respective axes of symmetry of each of the hollows.

According to a second aspect of the present invention there is provided a method of manufacturing a device for focused explosions with controlled fragmentation, the method comprising:

shaping an explosive charge with a plurality of hollows;

placing the explosive charge in a hollow container;

placing the hollow container in a rigid shell:

defining a gap between the container and the rigid shell with a selected gap size, the gap size defining at least partly how an explosion at a given hollow impacts the rigid shell, thereby controlling fragmentation of the rigid shell.

In embodiments, the hollows are cones, each cone having a radius at a surface of the explosive charge and an apex into the explosive charge.

The method may comprise arranging the apexes to be equidistant from a detonation point located in the explosive charge.

Embodiments of the method may comprise setting the gap size to be smaller than twice a largest cone radius.

The method may comprise electroplating the hollows.

The method may comprise forming the hollows by machining openings in the container, inserting cones and filling the explosive charge into the container between the cones.

The method may comprise forming the hollows by machining into the explosive charge.

The method may comprise inserting cones into the hollows.

The method may comprise:

placing a detonation point in the explosive charge;

making the hollows symmetrical along respective axes; and aligning the axes with the detonation point.

The method may comprise placing a shock absorbent layer within the rigid shell.

In embodiments, a detonation at the detonation point is consequential on another explosion, or may be the result of remote detection of incoming ordnance, say via radar, or the detonation may be due to a triggering screen, or impact on a plate, or any other known method of detonation.

In a further aspect of the present invention there is provided a device for producing focused explosions, comprising:

a rigid outer shell;

an explosive filling, the explosive filling comprising a plurality of hollows extending inwardly along respective axes towards an apex; and at least one detonation point within said explosive filling, each axis and corresponding apex being aligned with at least one said detonation point.

In a yet further aspect of the present invention there is provided a device for producing focused explosions in a fluid, comprising:

an explosive body, the explosive body comprising a plurality of hollows extending inwardly along respective axes towards an apex;

at least one detonation point within said explosive body, each axis and corresponding apex being aligned with at least one said detonation point; and wherein said fluid extends inwardly of said hollows. The fluid may be water, and the device may be suitable for underwater use. In the underwater case, the rigid outer shell may be dispensed with since fragmentation is less relevant.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
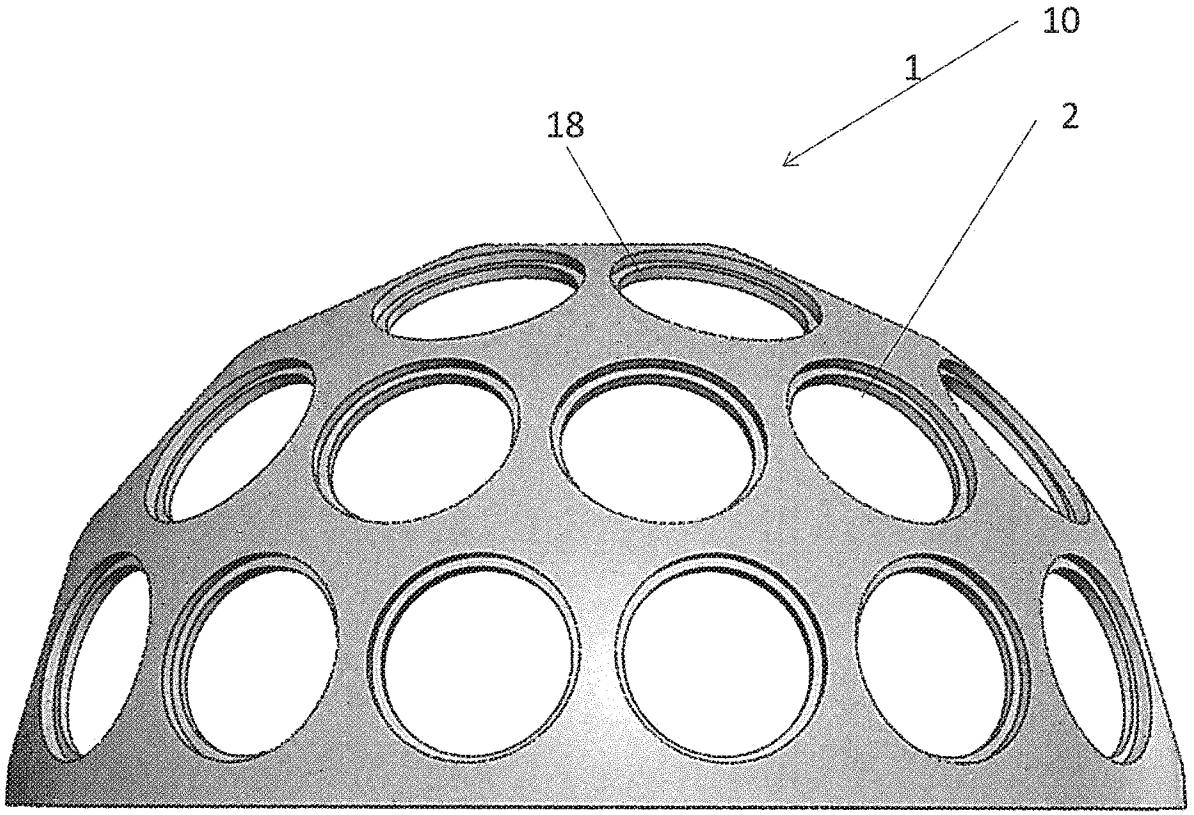
FIG. 1 is a hollow container with openings according to a first embodiment of the present invention.

The present invention relates to a device for focusing of explosions and a method of manufacturing the same. More particularly the device interferes with the construction of the HEAT jet in order to control fragmentation of a rigid outer cover.

A device according to the present embodiments is for producing focused explosions in multiple directions, and/or from multiple centers, or more specifically for focusing the energy of an explosion in various ways. The device may comprise a rigid outer shell, a hollow container or an electroplated coating, and an explosive filling, the explosive filling comprising a plurality of inwardly extending hollows; and a gap defined between the explosive filling and the rigid outer shell. The explosion may form or partly form, a jet from the interaction with the hollow container and/or the lining within the hollows, and then the jet, which is a high energy anti-tank jet, strikes the rigid outer shell across the gap and launches the fragments. A size of the gap dictates the extent of interference with the formation of the jet and hence dictates the area of the rigid outer shell that is impacted. That is to say the construction may interfere with the formation of the jet. Energy from the jet is utilized in fragmentation of the outer shell to produce fragments that are launched at an improved speed.

The hollows may be of any shape that is symmetrical about an axis extending into the depth of the explosive, and a cone is a typical example. The different hollows may have their axis of symmetry aligned to a common detonation point.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 2:
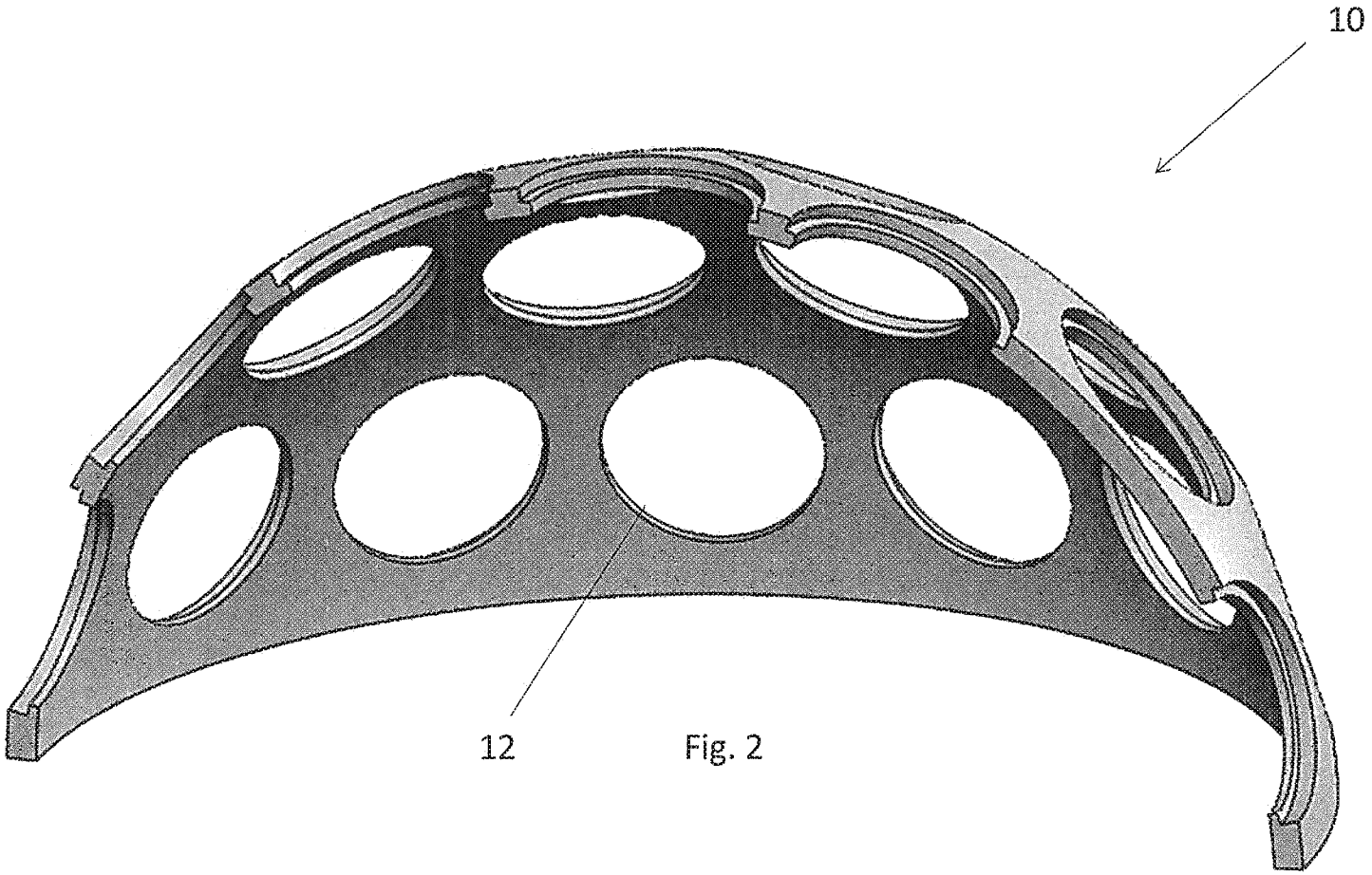
FIG. 2 is a cross section of the hollow container of FIG. 1.
Figure 3:
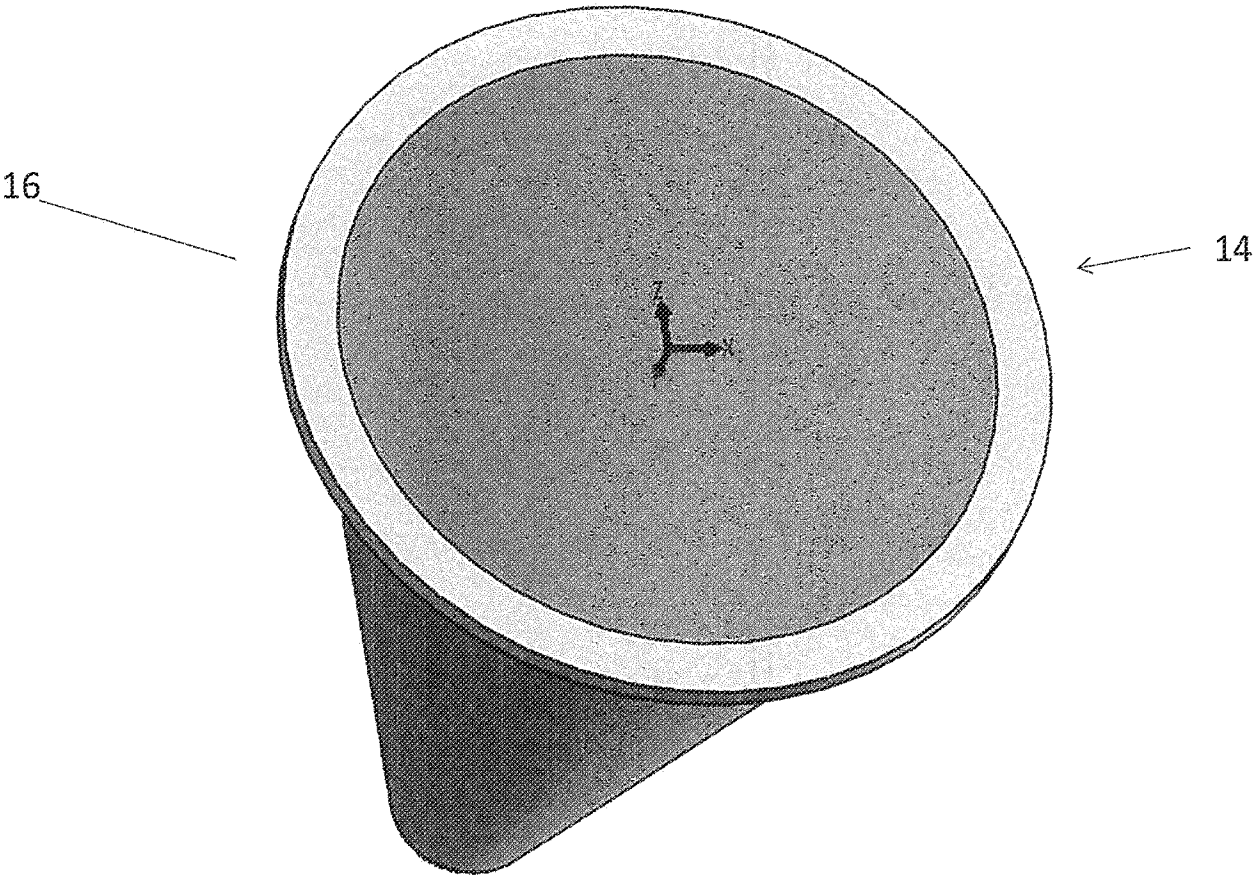
FIG. 3 is a cone for use with the hollow container of FIG. 1.

Referring now to the drawings, FIG. 1 illustrates a hollow container 10 having machined holes 12. FIG. 2 shows a cutaway view from inside of the same rigid outer cover. FIG. 3 shows a cone 14 that may be fitted into the machined holes 12 to extend inwards. The cones may be made of aluminum, copper or other metals, or high density or high rigidity polymers, or just polymers, and, particularly in the case of polymers may be electroplated using any material that allows for electroplating. In embodiments, the cones may be made of multiple materials, say metal powder mixed in a polymer, or a ceramic mixed in a polymer. The hollow outer shell may be made of the same materials. The cone may have a rim 14 to fit over the hole, or to fit into a step in the hole to hold the cone firmly.

In an embodiment the cone may be made of metal with the polymer, and the percentage of the metal in the mixture, the type of polymer, and the wall thickness, all affect the nature of the explosion and formation of the jet and how it causes fragmentation at the rigid outer shell. Furthermore, the plastic may typically evaporate, to leave the metal to form the jet, and the conditions for evaporation, in particular pressure, may be changed by the details of the cone construction.

Figure 4:
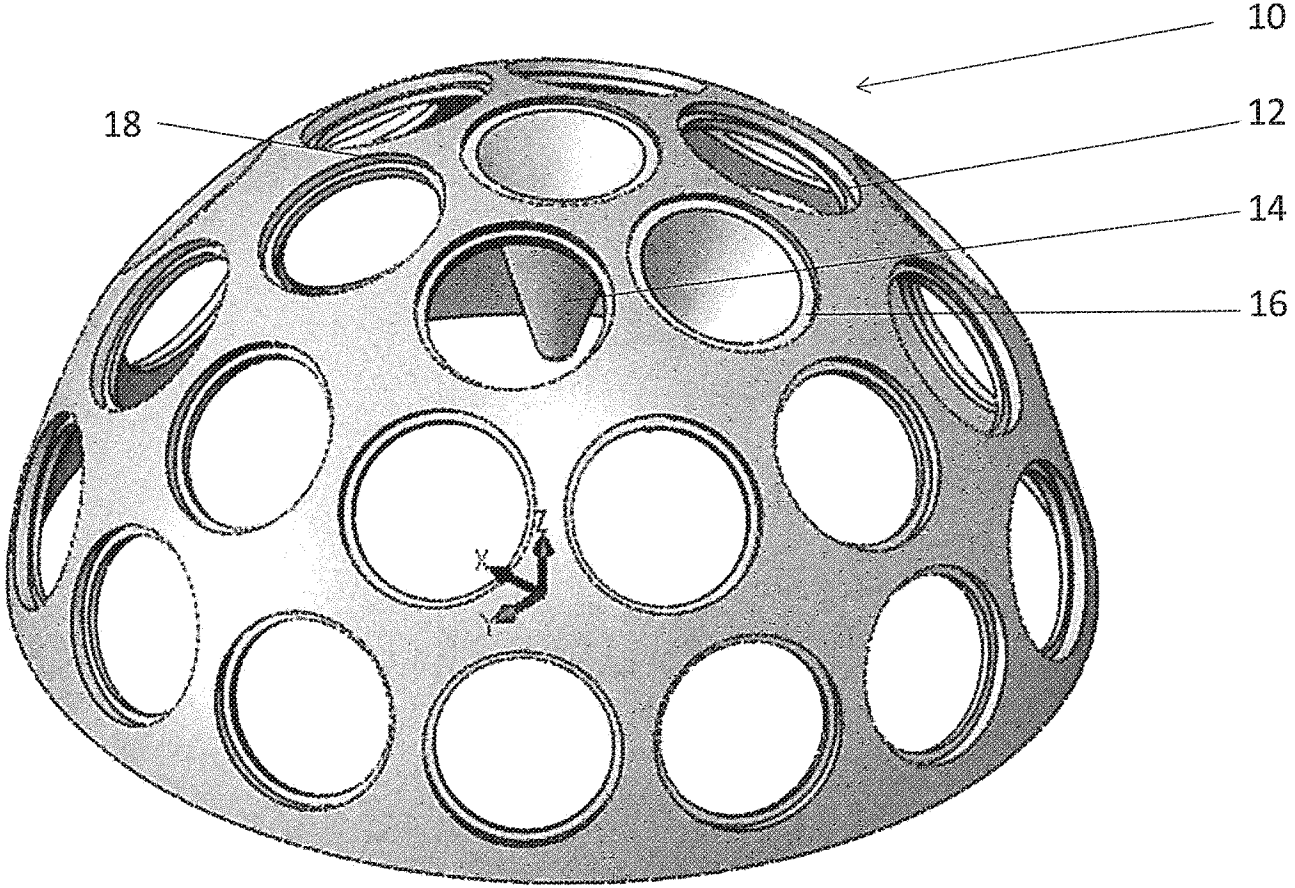
FIG. 4 shows the cone of FIG. 3 inserted into the hollow container of FIG. 1.

FIG. 4 illustrates the hollow container 10 with cones 14 inserted into two of the holes 12. Rim 14 fits over a step 18 in the edge of the hole. The hollow container 10 provides a superstructure to hold the cones firmly in position with respect to the explosive. It is possible to provide grooves in the rigid outer shell itself and to insert the cones directly. In such a case there is no separate hollow container and the outer shell provides the superstructure.

Figure 5:
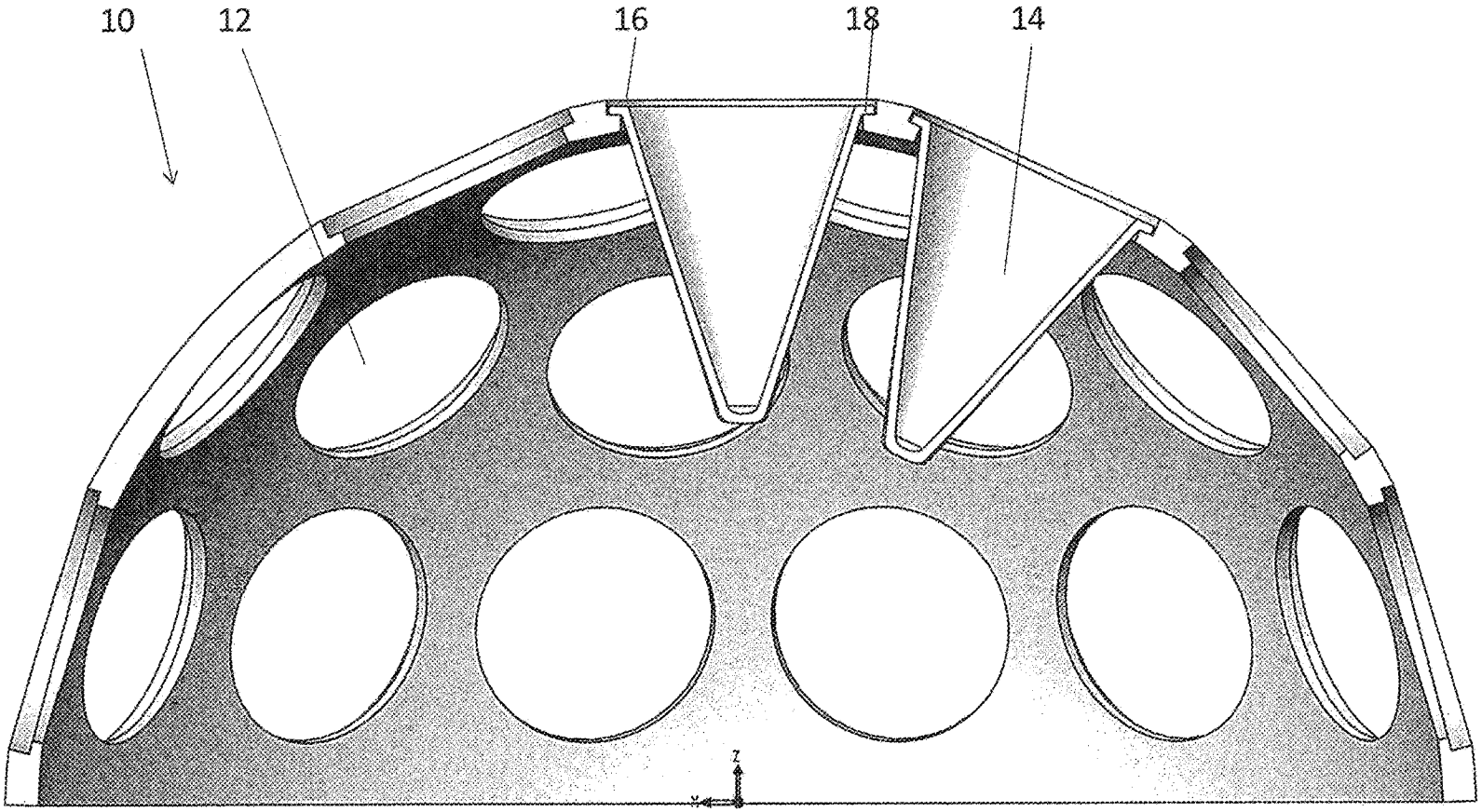
FIG. 5 is a cross section of the embodiment of FIG. 4.

FIG. 5 is a cross section of the hollow container of FIG. 4. Again, cones 14 are inserted into two of the holes 12. Rim 14 fits over a step 18 in the edge of the hole.

Figure 6:
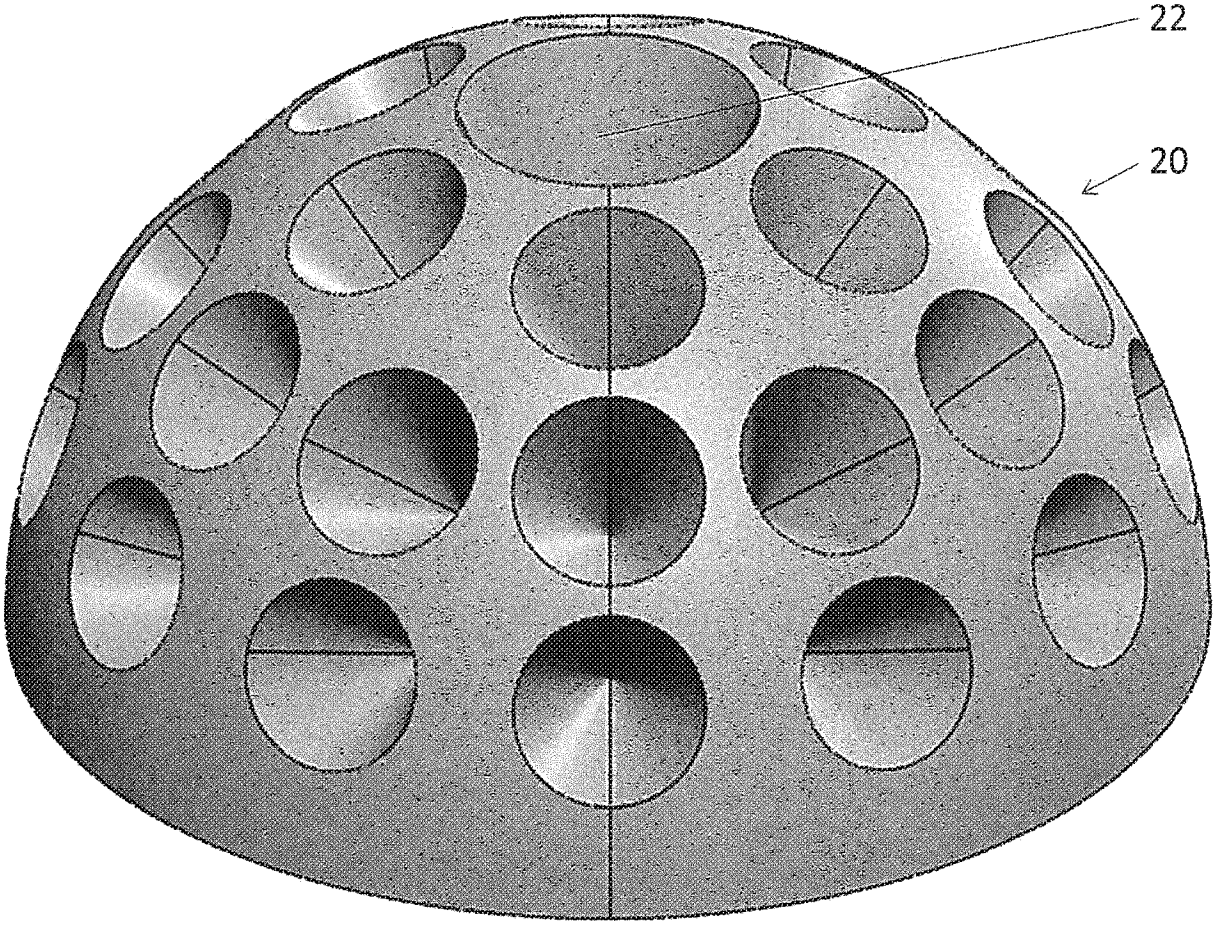
FIG. 6 is a hollow container according to an alternative embodiment of the present invention.

Reference is now made to FIG. 6, which is a variation 20 of the hollow container 10 of FIG. 1. In FIG. 6, cones 22 are machined directly into rigid outer cover 20. It is noted that different cone shapes are of different sizes, and the purpose is to provide different amounts of power of focused explosion in different directions. Likewise the apex angle of the cone may be varied in size to produce different effects on the focusing of the explosion, or the shape of the apex may be varied, say straightened or rounded, and also the thickness of the cone walls may have an effect. Specifically, the greater the thickness of the cone wall the slower the blast may progress, providing an additional option for focusing the blast.

Figure 7:
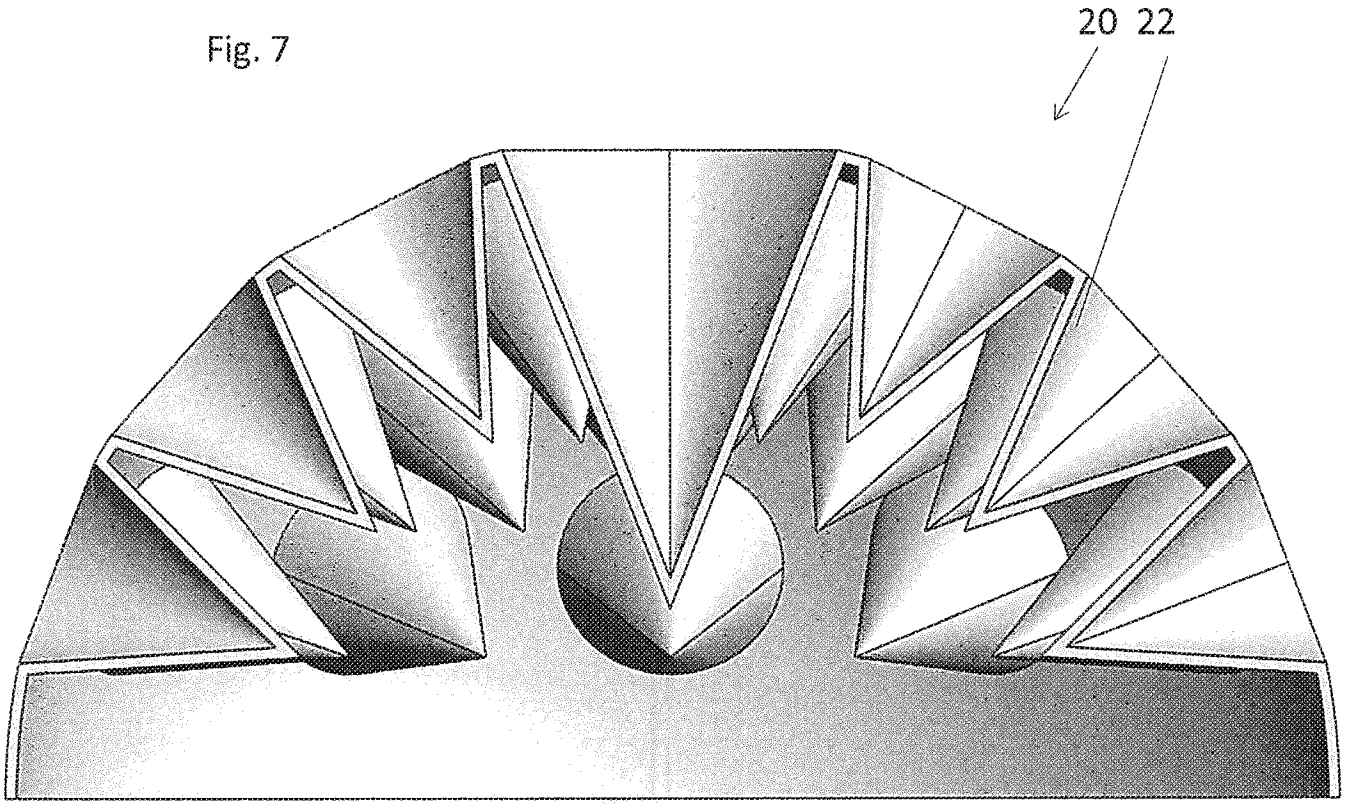
FIG. 7 is a cross section of the embodiment of FIG. 6.

Furthermore the composition of the cone walls may be varied. A further variable is the spacing between the cones and their spatial arrangement in general. Different size holes may be provided for all the embodiments of the present invention. FIG. 7 shows a cutaway view of the embodiment of FIG. 6.

In an embodiment all the apexes of the cones point to the same location and are equidistant therefrom. That same location is where the detonator starts the explosion, thus ensuring that the varying focused explosions are as close as possible to simultaneous. Otherwise one explosion happening before the others would be liable to disrupt the others. Furthermore, the cones are all angled so that the line to the detonation point is continuous with an axial line of symmetry of the cone so that the initial detonation proceeds symmetrically around the cone.

Figure 8A:
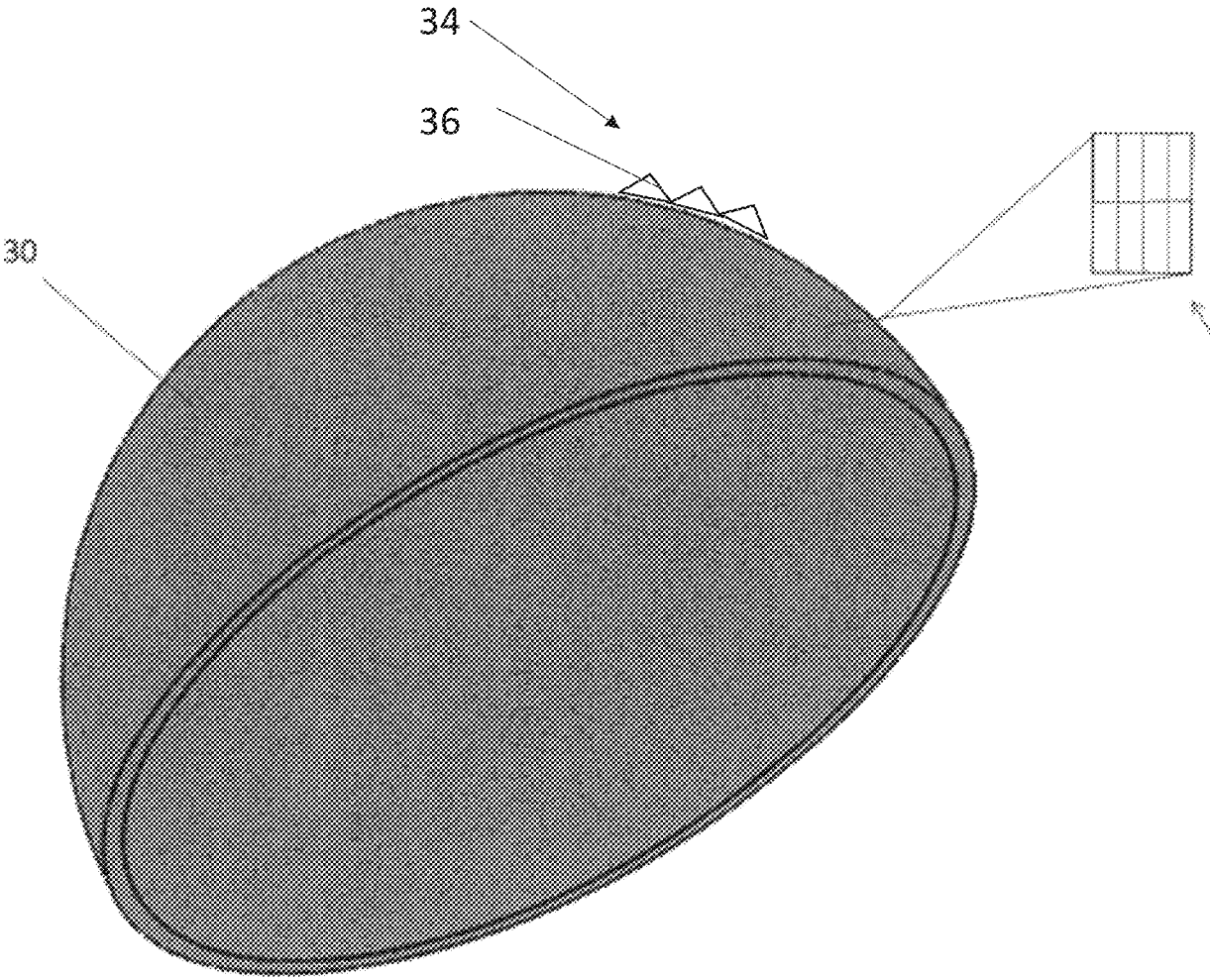
FIGS. 8A and 8B show rigid outer covers for use in embodiments of the present invention.

FIG. 8A shows a rigid outer cover for placing over the outside of the device. In this case the rigid outer cover 30 is smooth. In other embodiments, the rigid outer cover may include grooves, to aid with fragmentation, as shown in inset 32. The grooves may be on the inside or the outside of the rigid outer cover, or both. The depth of the grooves may be selected in accordance with the size and dimensions of the neighboring cone, so that a rigid outer cover with varying grooves is provided that is configured specifically to fragment in optimal manner according to the arrangement of cones. Reference numeral 34 indicates an alternative construction in which grooving is provided by means of ridges 36 having a substantially triangular cross section. Other cross-sections such as rounded cross-sections may be considered.

Figure 8B:
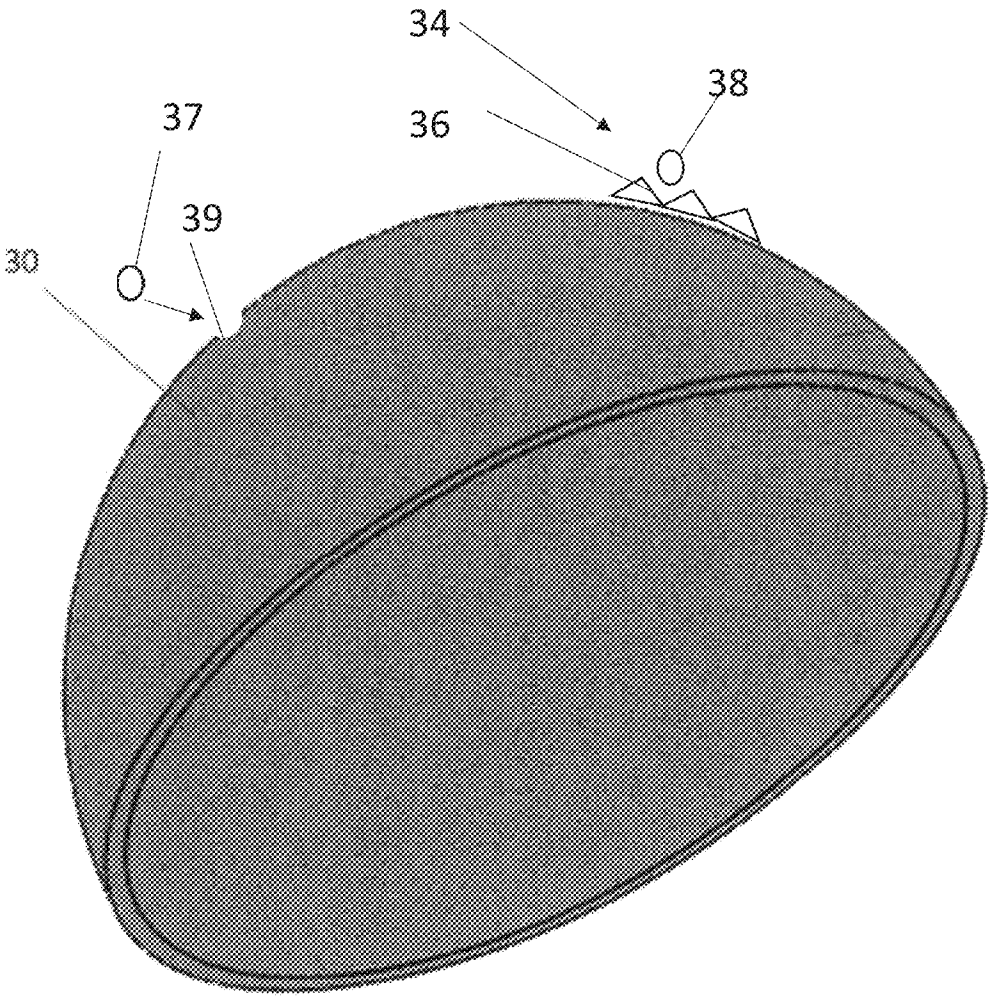

Reference is now made to FIG. 8B which shows how a hard object 38 may be inserted into the grooves between triangular ridges 36. Alternatively, hollows or cavities 39 may be built into the rigid outer case and hard objects 37 may be inserted into the cavities. In all cases the idea is to provide optimization for high energy fragments.

It is noted that the grooves, hard bodies, indentations etc. may be part of an additional cover placed over the rigid outer cover of the explosive body.

Figure 10A:
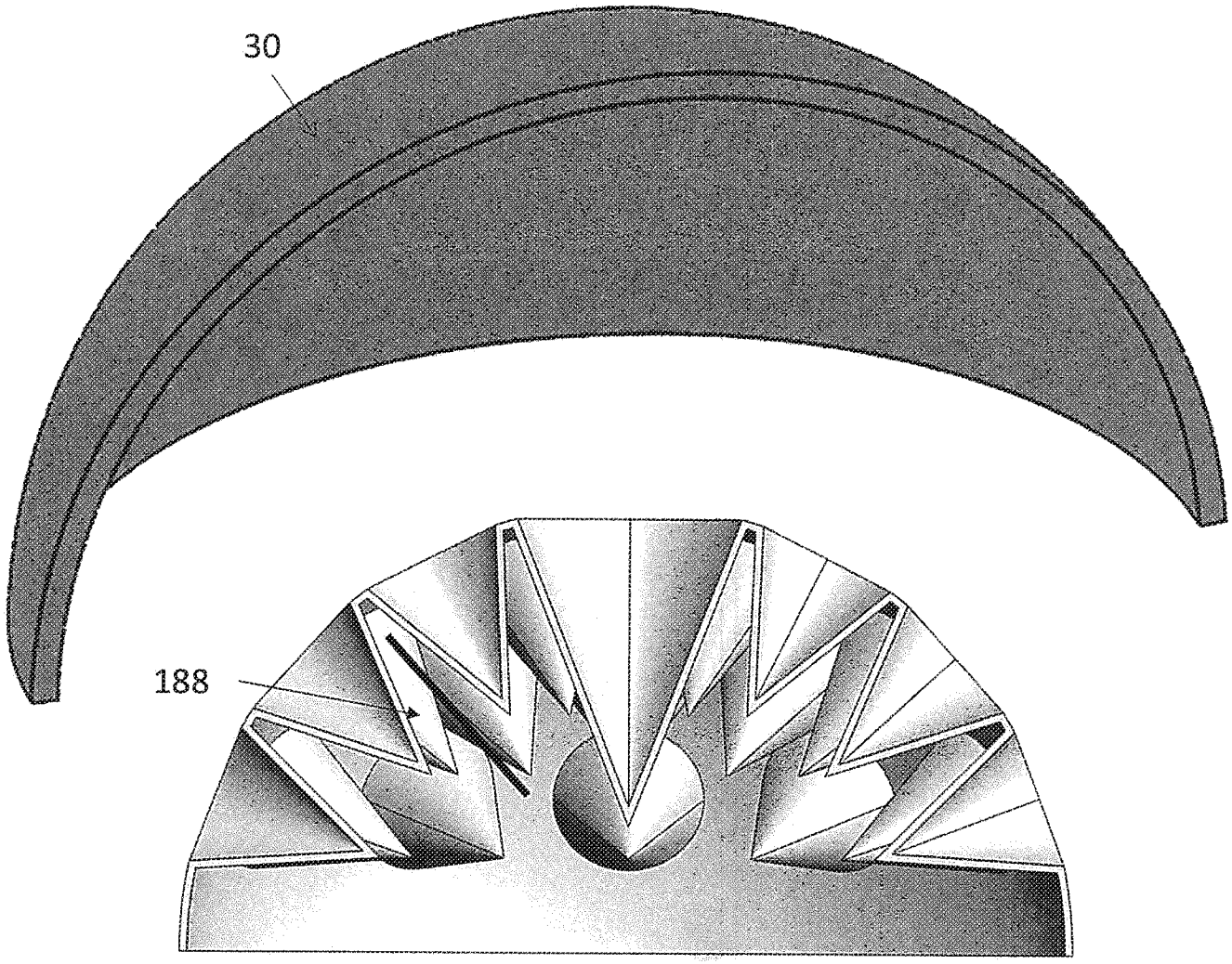
FIGS. 10A and 10B are schematic cross-sectional views and a view from above of an explosive device according to embodiments of the present invention.
Figure 10B:
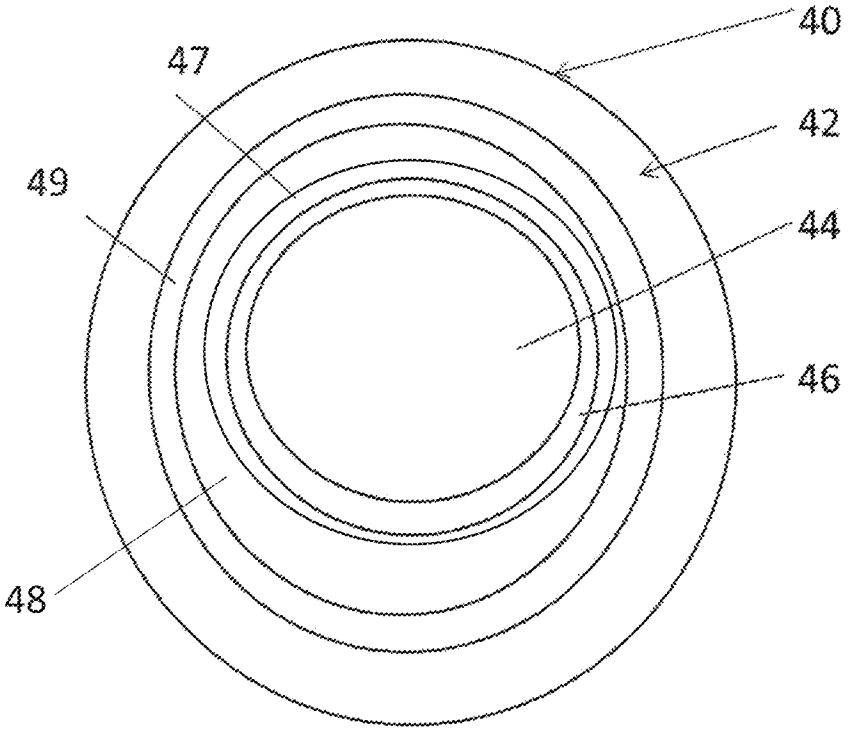

Referring now to FIGS. 10A and 10B, and an explosive device 40 includes rigid outer cover shell 42, for example according to the embodiment of FIGS. 8A-B. Device 40 is for producing focused explosions. Within the shell an explosive filling 44 is located which has multiple inwardly extending hollows, typically within a hollow container 46 as described above.

Depending on the embodiment, the hollows may be defined by shapes built into the shell or machined or otherwise provided in the explosive itself, as per the different embodiments of outer shell. The explosive filling or the hollow container may additionally be coated with coating 47, which may be of copper or aluminum and may conveniently be electroplated. If the coating is directly on the explosive then the coating may coat the walls of the hollows as well. If the coating is over the hollow cover then the coating will in any case extend within the hollows. A gap 48 may be placed or define between the explosive filling and the rigid outer shell, as will be discussed in greater detail hereinbelow.

In embodiments, the inwardly extending hollows are cone-shaped, and the cone may taper inwardly towards the center of the explosive. Different hollows, whether cone shaped or otherwise, may be of different sizes. More particularly, the inwardly extending hollows have bases at the surface of the explosive filling, each base having a particular radius. The gap 48 between the rigid outer cover 42 and the explosive 44 in one embodiment has a size which is less than twice the largest of these radii. The explosive forms a directed explosion defined by the hollows and the copper or aluminum in the coating forms a metallic jet. A gap of more than twice the radius allows the jet to be fully formed. A gap that is smaller than twice the radius may only allow the jet to partly form. The partly formed jet smashes into the rigid outer shell 42 and causes a pattern of fragments of different sizes. The metal of the jet in fact accelerates the fragments of the outer shell.

A fully formed jet by contrast punches a relatively clean hole in the rigid outer cover and produces a smaller number of and/or larger fragments in a much tighter pattern, and the fragments may travel more slowly. In an alternative embodiment, the gap is larger than twice the radius.

The limited size of the gap is to disrupt complete formation of the jet. A fully formed jet is very concentrated and makes a puncture in the outer shell that does not cause much fragmentation. On the hand a gap that is smaller barely allows the jet to concentrate and thus causes greater fragmentation and higher speed of the fragments created.

The coating 46 may be manufactured using electroplating, and may be made of copper or aluminum or mixtures including the same. The rigid outer cover 44 may be made of metal or ceramics or a mixture.

The metal may be aluminum.

The cone shape is only an example and any hollow may be suitable. As well as the size of the gap, the size of the cone also helps to define the pattern of the explosion. Larger cones may provide larger fragmentation spheres, and different patterns of sized cones may be used to direct force in particular directions. That is to say one may direct the force of the blast with a pattern of larger and smaller cones. Such an arrangement is useful, particularly in reactive armor, for directing explosions at incoming ordinance. Different sizes and shapes of cones may provide different sizes and energies of fragments and fragmentation patterns.

A detonating mechanism may be provided to detonate the device 40 in timed fashion to defeat the incoming ordnance. As mentioned, the detonation point may be equidistant from each of the cones.

FIGS. 10A and 10B shows a rounded explosive filling 44. However, the filling does not have to be round. Embodiments may for example have a wavy outline, or the filling could be extended lengthwise and have a triangular bite along the length to serve as a hollow.

Fragments are formed from the blast of the explosive punching into the rigid outer cover. The fragments are accelerated by the jet formed with the electroplating. A main jet, insofar as the gap size has allowed it to form, causes a large fragment, and the jet carries the metal of the fragment along with it. A Bernoulli effect works on bits of the outer cover around those directly punched by the blast to form smaller fragments.

It is noted that the cones can be of different materials. A shock absorption layer 49 may be placed on the inside of rigid outer she 42 to protect the inside of the device from external mechanical impacts.

Figure 9:
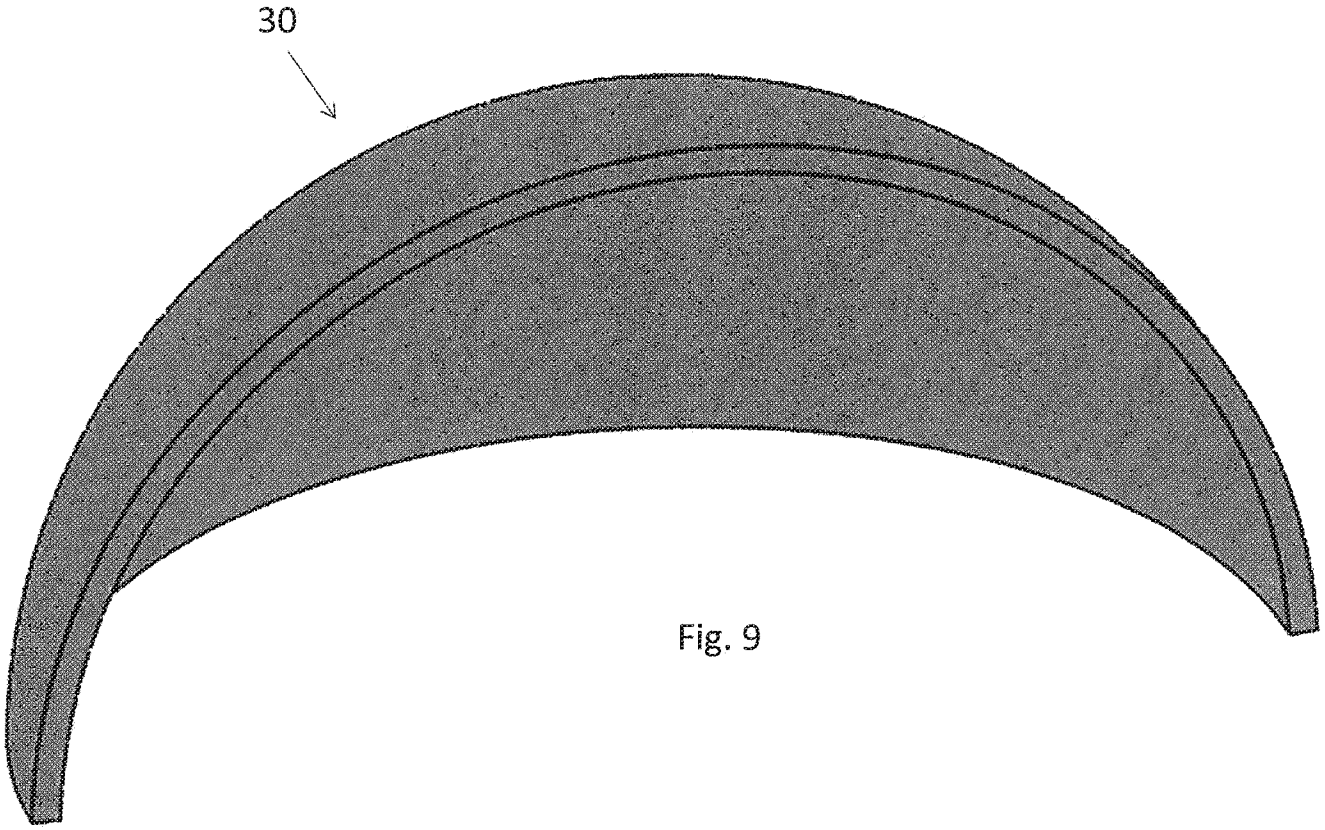
FIG. 9 is a cross section of the embodiment of FIGS. 8A-B.
Figure 11:
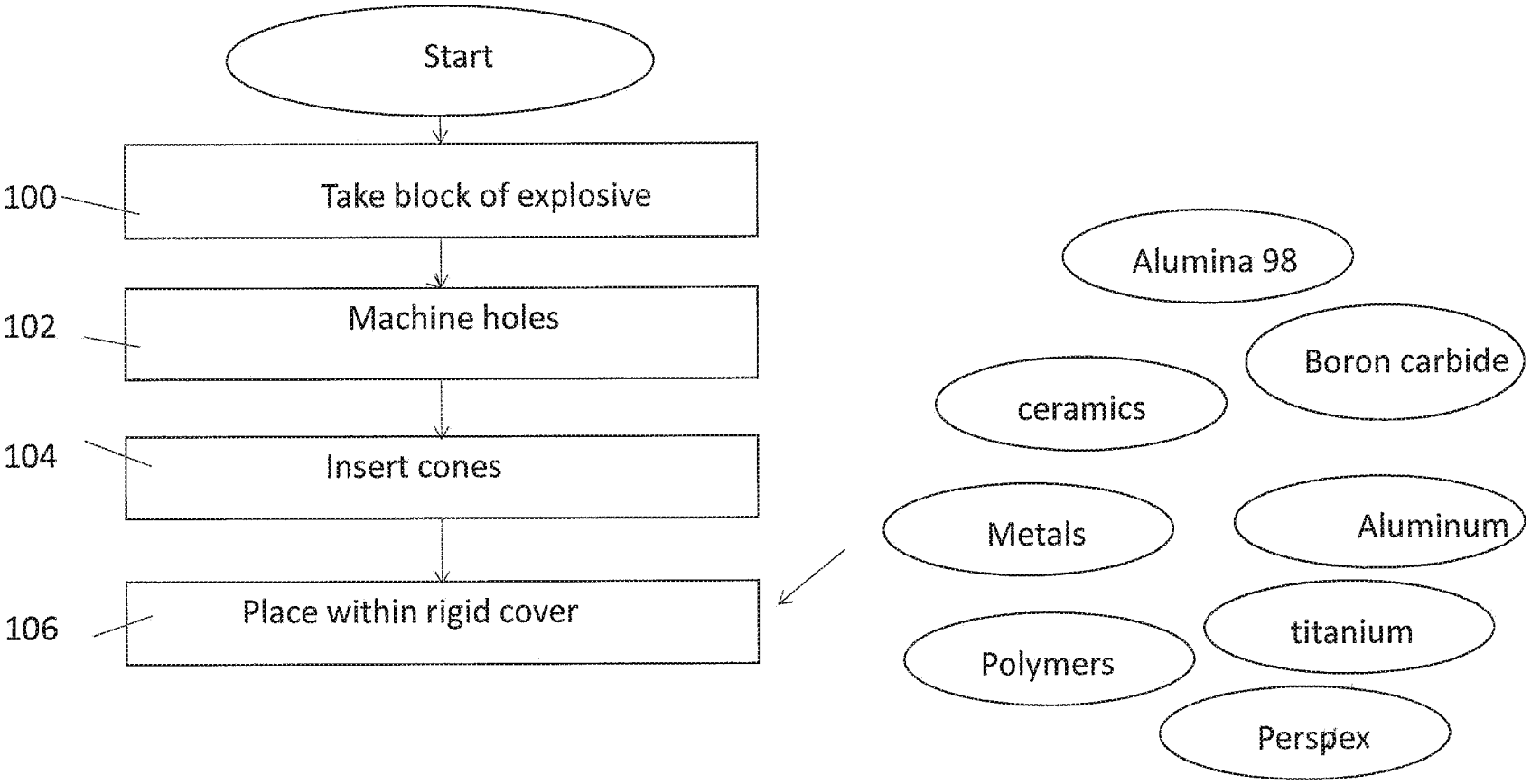
FIGS. 11, 12, 13, 14 and 15 are variant methods of manufacturing the device of FIG. 10A.

Reference is made to FIG. 11 which is a flow chart showing a method of manufacturing the device of FIG. 10A. A block of explosive is shaped into a round or wavy or elongated shape as desired—100—and then holes are machined into the explosive—102. Cones are inserted into the machined holes—104 and the whole is placed within a rigid outer cover—106, such as that shown in FIG. 9 above. Materials that may be used for the rigid outer cover include ceramics, metals and polymers.

Examples of polymers include Perspex™. Metals may be aluminum or titanium etc.

Examples of ceramics are boron carbide and Alumina98™.

Figure 12:
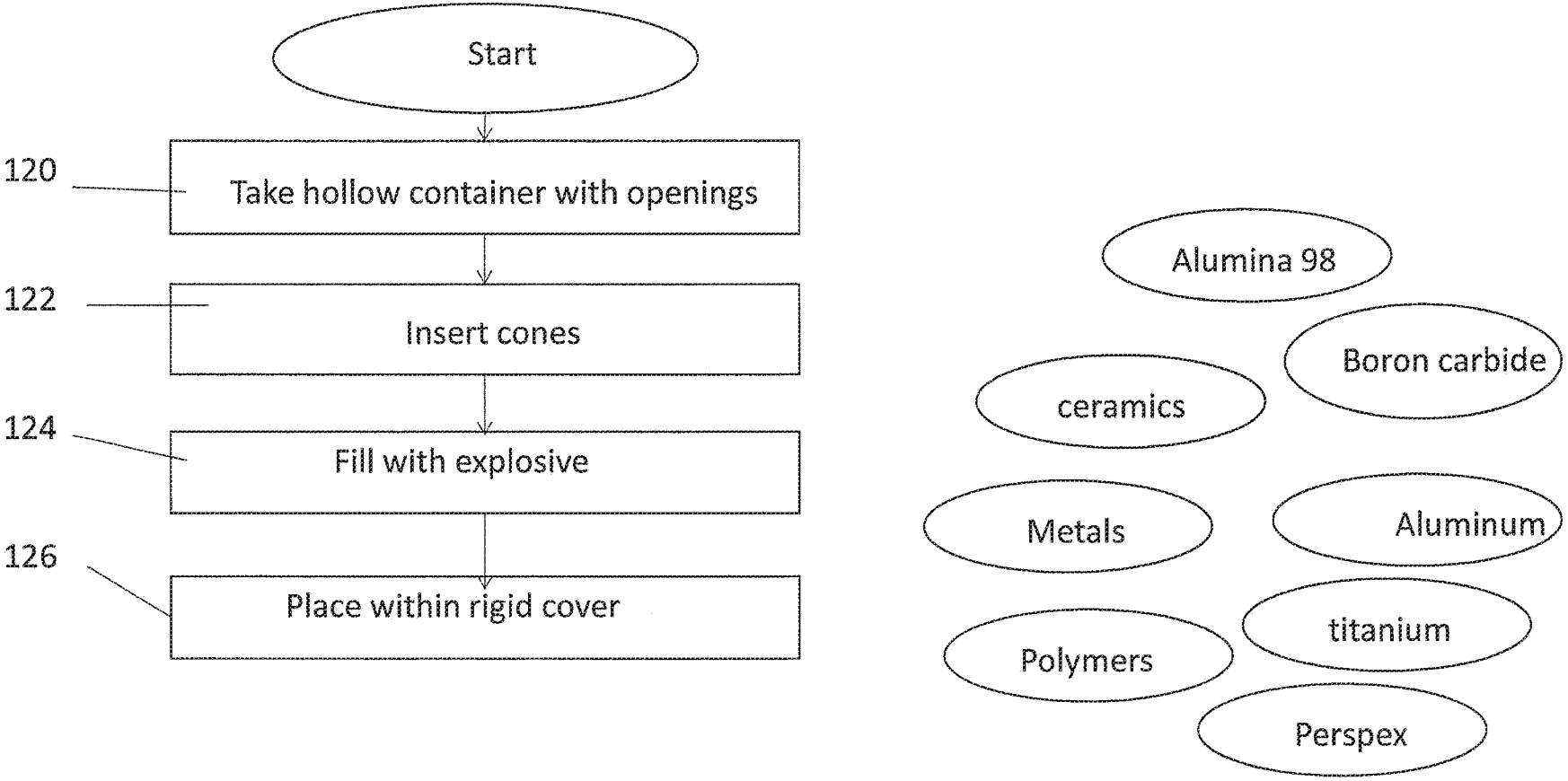

FIG. 12 shows an alternative method of manufacturing the device of FIG. 10A. In FIG. 12, a hollow container with openings is provided—120, to house the explosive. Cones are inserted—122, the hollow is filled with explosive—124—and the explosive may be separately coated with copper or aluminum. The whole is placed within a rigid outer cover—126. Materials that may be used for the rigid outer cover again include ceramics, metals and polymers. Examples of polymers include Perspex™. Metals may be aluminum or titanium etc. Examples of ceramics are boron carbide and Alumina98™.

Figure 13:
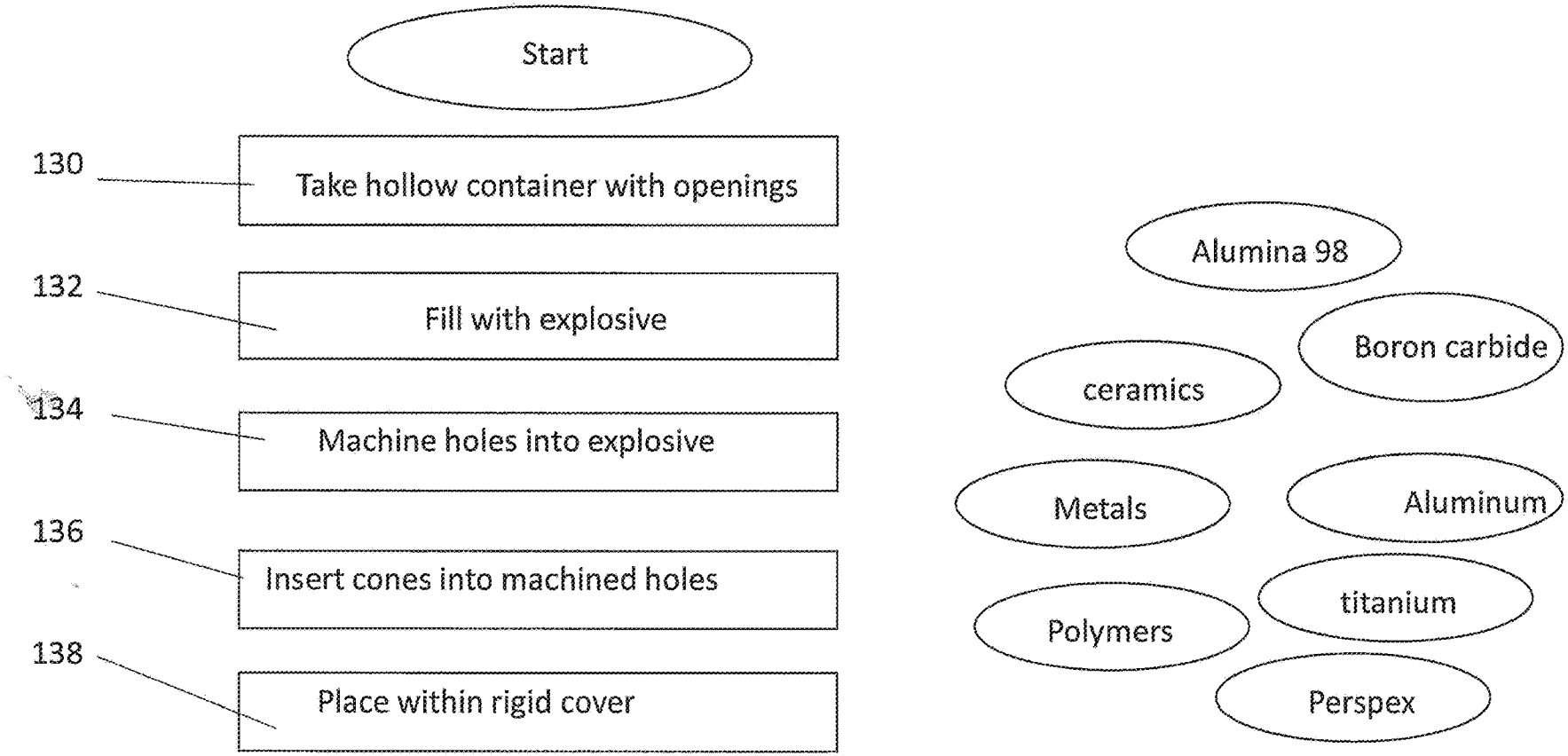

FIG. 13 shows another alternative method of manufacturing the device of FIG. 10A. In FIG. 12, a hollow container with openings is provided—130. Explosive is placed in the cover-132. Hollows are machined though the holes in the cover into the explosive—134. Cones are inserted—136 into the machined hollows through the holes and the whole is placed within a rigid outer cover—138. Materials that may be used again include ceramics, metals and polymers. Examples of polymers include Perspex™. Metals may be aluminum or titanium etc. Examples of ceramics are boron carbide and Alumina98™.

Figure 14:
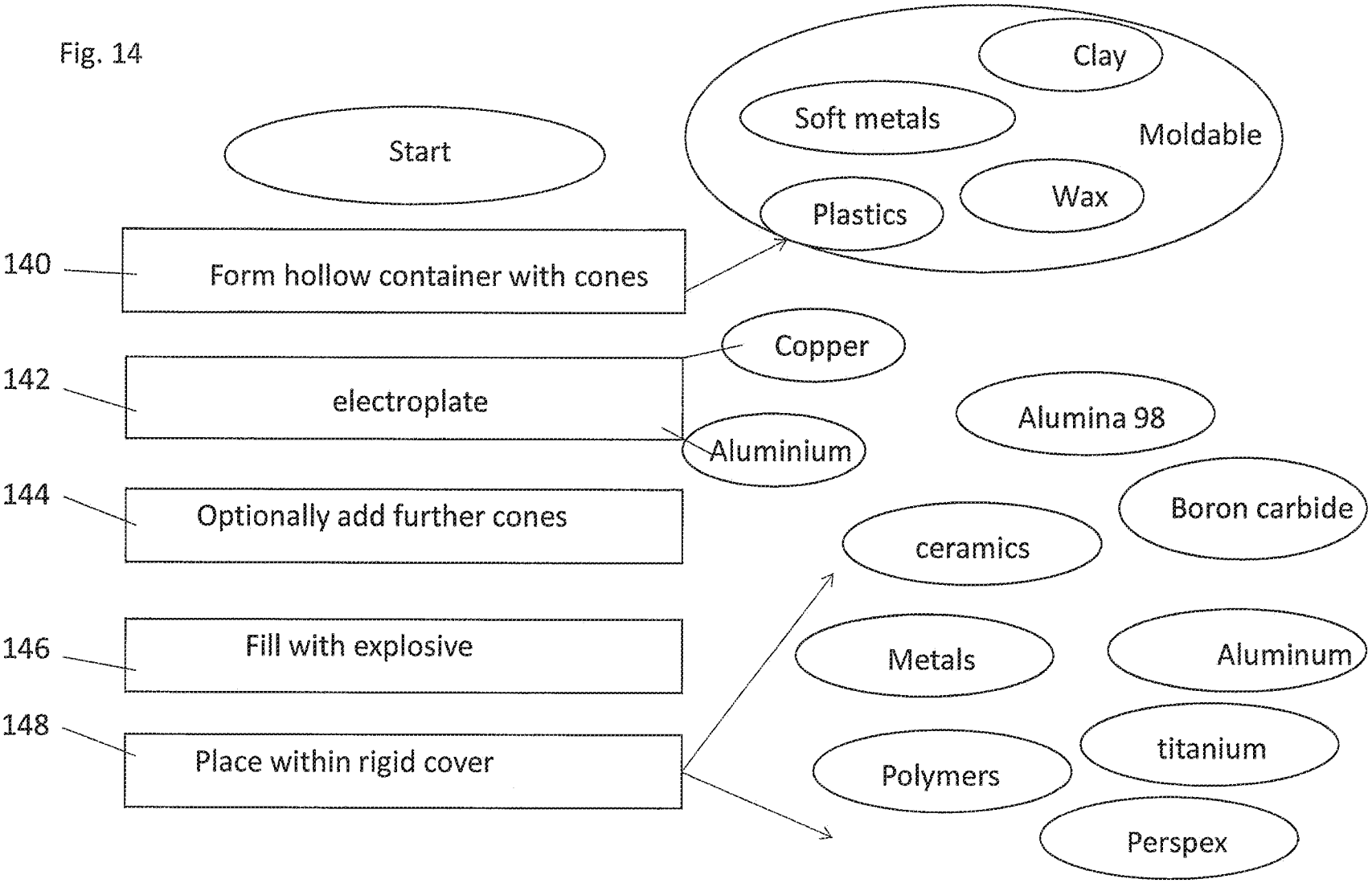

FIG. 14 shows an alternative method of manufacturing the device of FIG. 10A. In FIG. 12, a hollow container with openings is provided—140 and the hollow container may be made of soft metals, plastics, wax, or clay and may be molded. Electroplating of the hollow container is carried out—142 and materials may for example include aluminum or copper. Further cones are optionally inserted—144, the space in the hollow container is filled with explosive—146, and the whole is placed within a rigid outer cover—148, the separate hollow container helping to define the gap. Materials that may be used for the rigid outer cover again include ceramics, metals and polymers. Examples of polymers include Perspex™. Metals may be metals, metallic alloys, steel, steel alloys, aluminum or titanium etc. Examples of ceramics are boron carbide and Alumina98™. Any combinations of the materials and families may be used.

In an embodiment, the rigid outer shell may be dispensed with, for example if the device is intended for underwater use.

Figure 15:
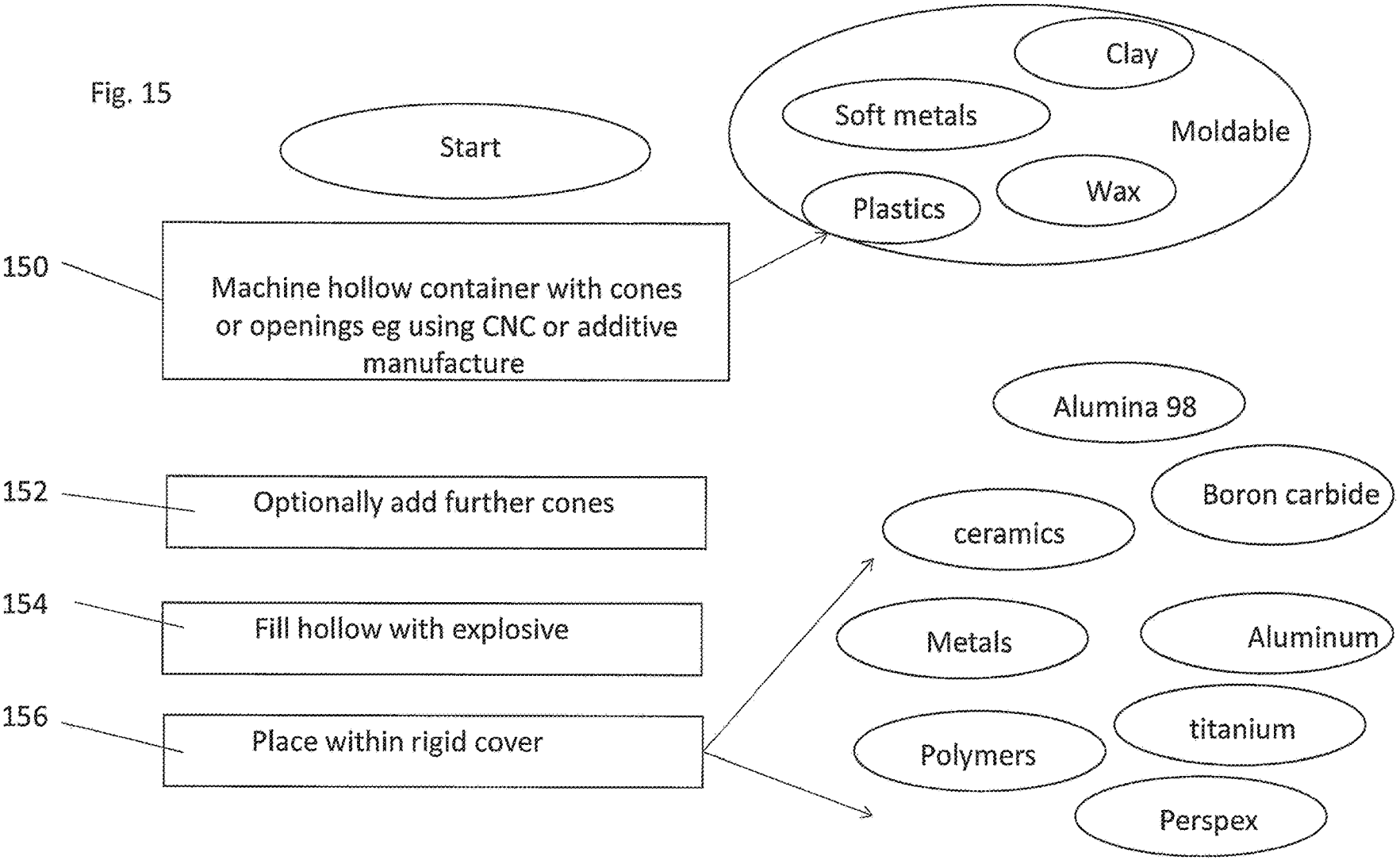

FIG. 15 shows a yet further alternative method of manufacturing the device of FIG. 10A.

In FIG. 12, a hollow container with cones or openings is provided—150, for example that shown in FIG. 1. The hollow container may be manufactured for example using CNC-based methods or using additive manufacture, and this observation applies to all embodiments herein.

The hollow container may be made of soft metals, plastics, wax, or clay and may be molded Optionally, further cones are inserted—152, and the hollow container is filled with explosive—154. The whole is placed within the rigid outer cover—126. Materials that may be used again include ceramics, metals and polymers. Examples of polymers include Perspex™. Metals may be aluminum or titanium etc. Examples of ceramics are boron carbide and Alumina98™.

Figure 16:
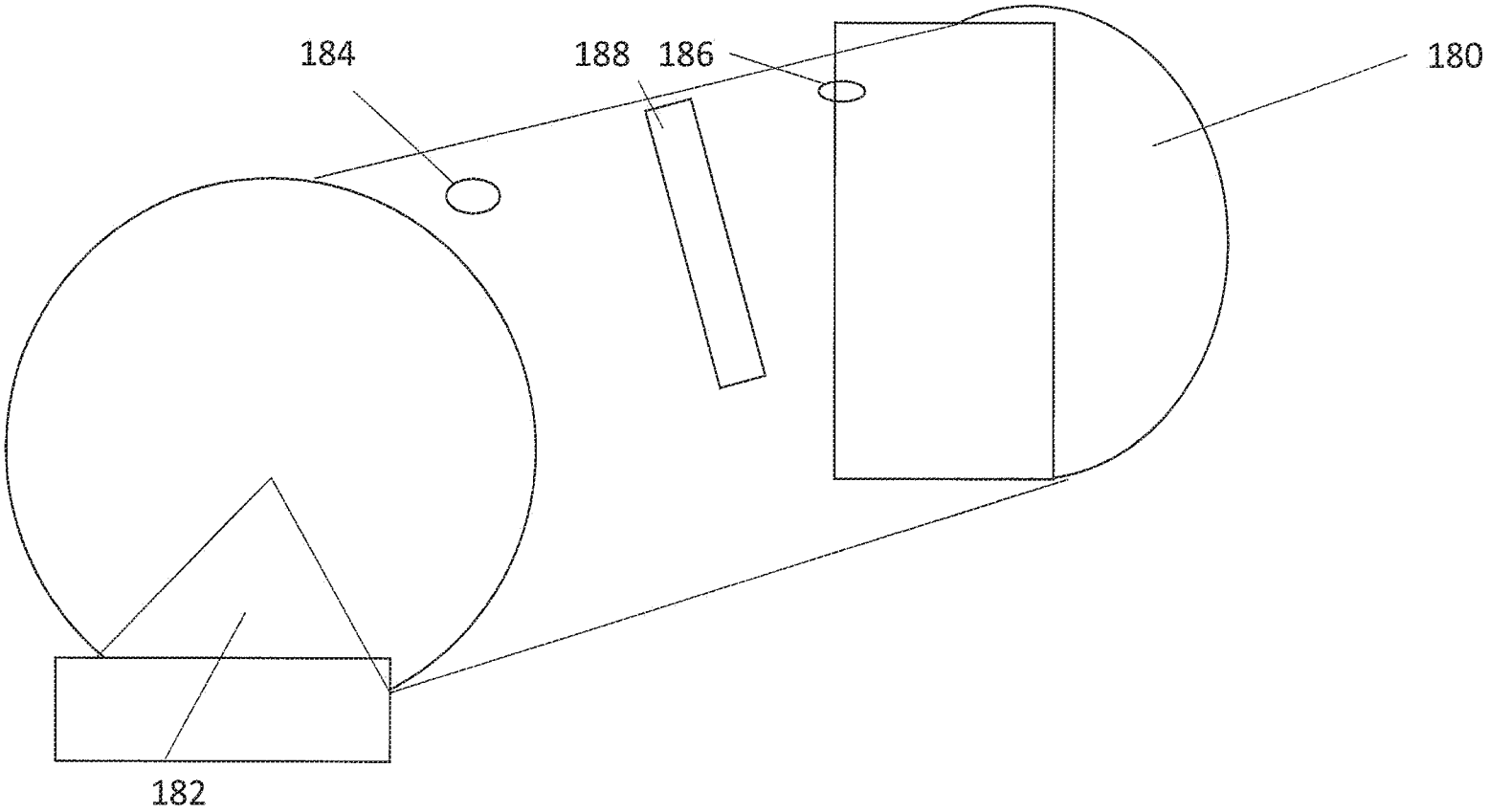
FIG. 16 is a simplified schematic diagram illustrating how the present embodiments may be applied to a cylindrical explosive.

Reference is now made to FIG. 16, which is a simplified diagram illustrating a non-spherical explosive charge 180 having a hollow 182 extending linearly along the charge. In this case, and purely by way of example, the charge is cylindrical. The hollow 182 has an axis of symmetry extending through the inwardly pointing apex and two detonation points 184 and 186 are located at various points along the explosive charge. Both detonation points may be aligned with the axis of symmetry. A baffle 188 may be located between the detonation points to slow down the separate explosions emerging from each detonation point to prevent them from interfering with each other. It will be appreciated that more hollows may be introduced around the circumference of the explosive and detonation points may be centrally located so as to coincide with all of the lines of symmetry. More than two detonation points may be placed, for example depending on the length of the explosive charge. In general the device is configured so that the hollows are focused on the directions of likely incoming threats.

The detonation point or points for any of the above embodiments may be self-detonating, say in response to an electrical signal or a pressure wave, or may be consequential on another explosion.

The embodiments may be mounted on a vehicle for protection from incoming ordnance, and explosions may be triggered by remote detection of the incoming ordnance, say using a radar detector, or the trigger may be impact on a metal plate or triggering screen or the like. A single remote detector may operate multiple devices on a vehicle or at any other location, or on one side of the vehicle, as appropriate.

In embodiments there is provided a device for producing focused explosions, comprising: a rigid outer shell, an explosive filling, the explosive filling comprising a plurality of hollows extending inwardly along respective axes towards an apex; and one or more detonation points within the explosive filling. It is noted that in the symmetrical case there is one detonation point. In cases where the explosive is elongated in one direction, then parts of the explosive which make a substantially symmetrical shape may be isolated using baffles and may be treated separately, having their own detonation points. Each axis and corresponding apex of any particular hollow is aligned with one of the detonation points, so that in the case of an elongated shape, the several detonation points may respectively detonate the hollows specifically around each detonation point. The gap referred to hereinabove is not used in this embodiment, and the various embodiments described hereinabove may also be reproduced in versions that dispense with the gap. The presence or absence of a gap defines the extent to which a jet is formed, whether fully, partially or not at all, and changes the way in which the rigid outer cover disintegrates into splinters or fragments. The rigid outer casing serves as an obstruction to the full or partial formation of the jet. The device may thus produce multiple simultaneous explosions focused in different directions.

Figure 17:
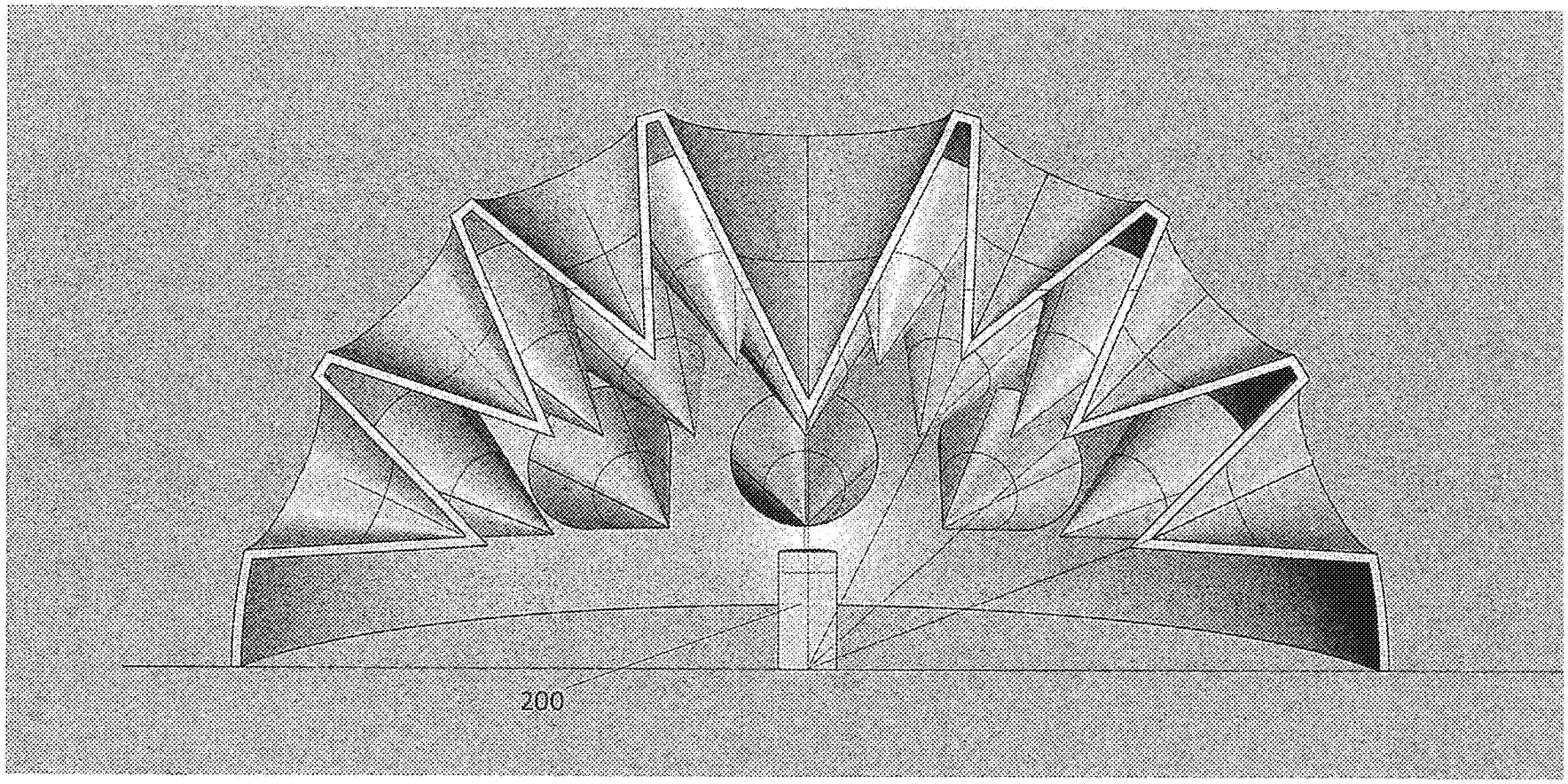
FIG. 17 is a variant of the embodiment of FIG. 4 showing a position of the detonator.

FIG. 17 is a simplified diagram showing the embodiment of FIG. 7 in which detonator 200 is located at a position aligned with the apexes of each of the cones.

Figure 18:
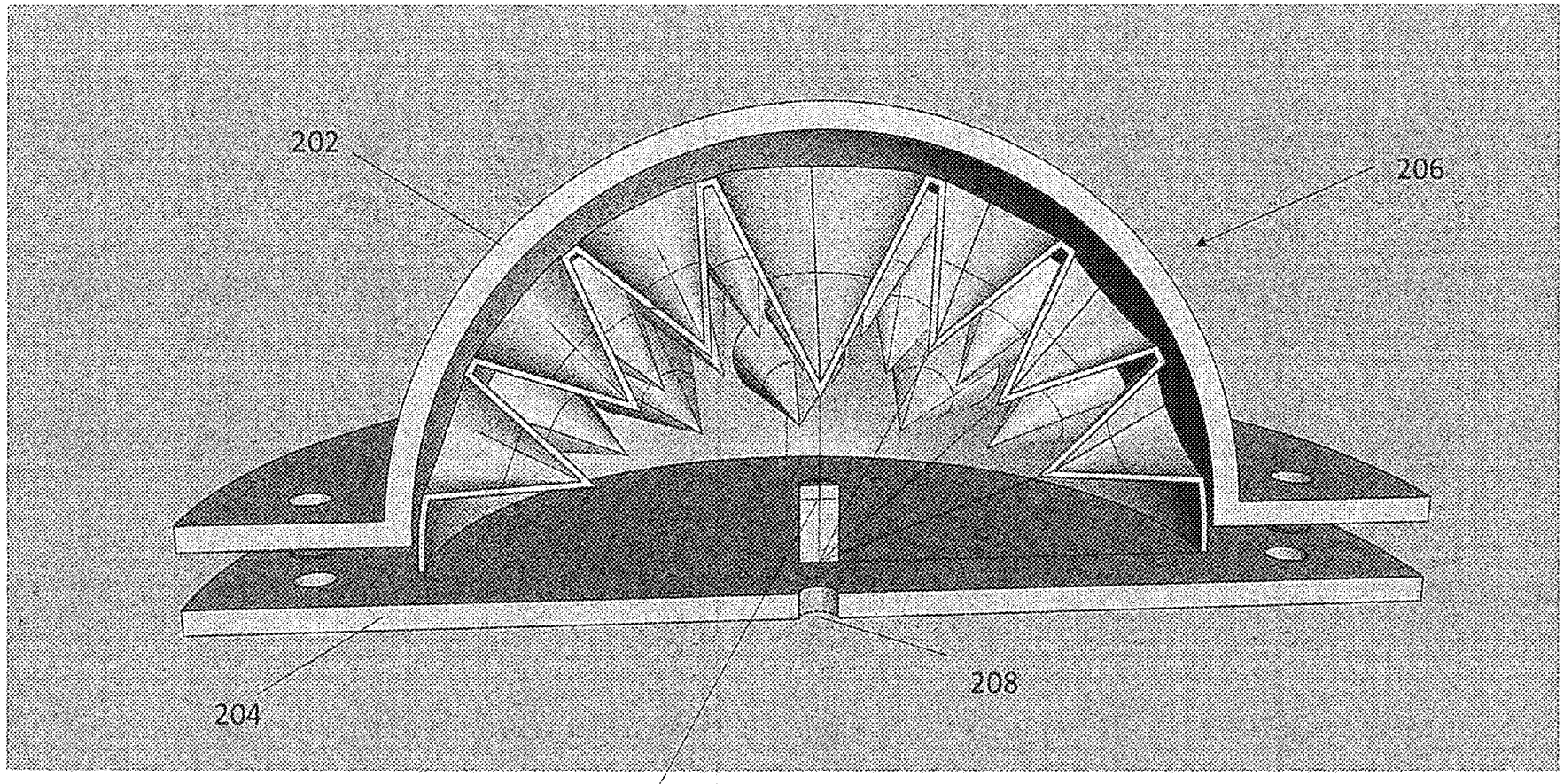
FIG. 18 shows the embodiment of FIG. 17 with surrounding plates.

FIG. 18 is a simplified diagram showing the embodiment of FIG. 17 including detonator 200. Rigid outer shell 202 is bolted to underplate 204 to form rigid structure 206. In place of detonator 200, explosive may be located in proximity to hole 208 to detonate the structure 206.

It is noted that by changing the shape and dimensions of the cones it is possible to change the speed of the blast and thus cause convergence of the blast and increase the amplitude in the focus directions.

It is further noted that the explosion imparts considerable kinetic energy to underplate 204, causing the underplate to carry a considerable part of the energy of the explosion. The underplate may be part of or act as a separate projectile to cause damage in the opposite direction of the main explosion. It is possible to design the explosive body so that the casing on one side does not break, causing most of the energy to be directed in the opposite direction. The cones may be used to focus the energy in conjunction with such a phenomenon. The construction may be used in order to provide focused energy to launch a separate projectile. For example the construction may be used to launch a shell or the like from a gun using focused energy. Thus in FIG. 18, the projectile replaces underplate 204.

Figure 19:
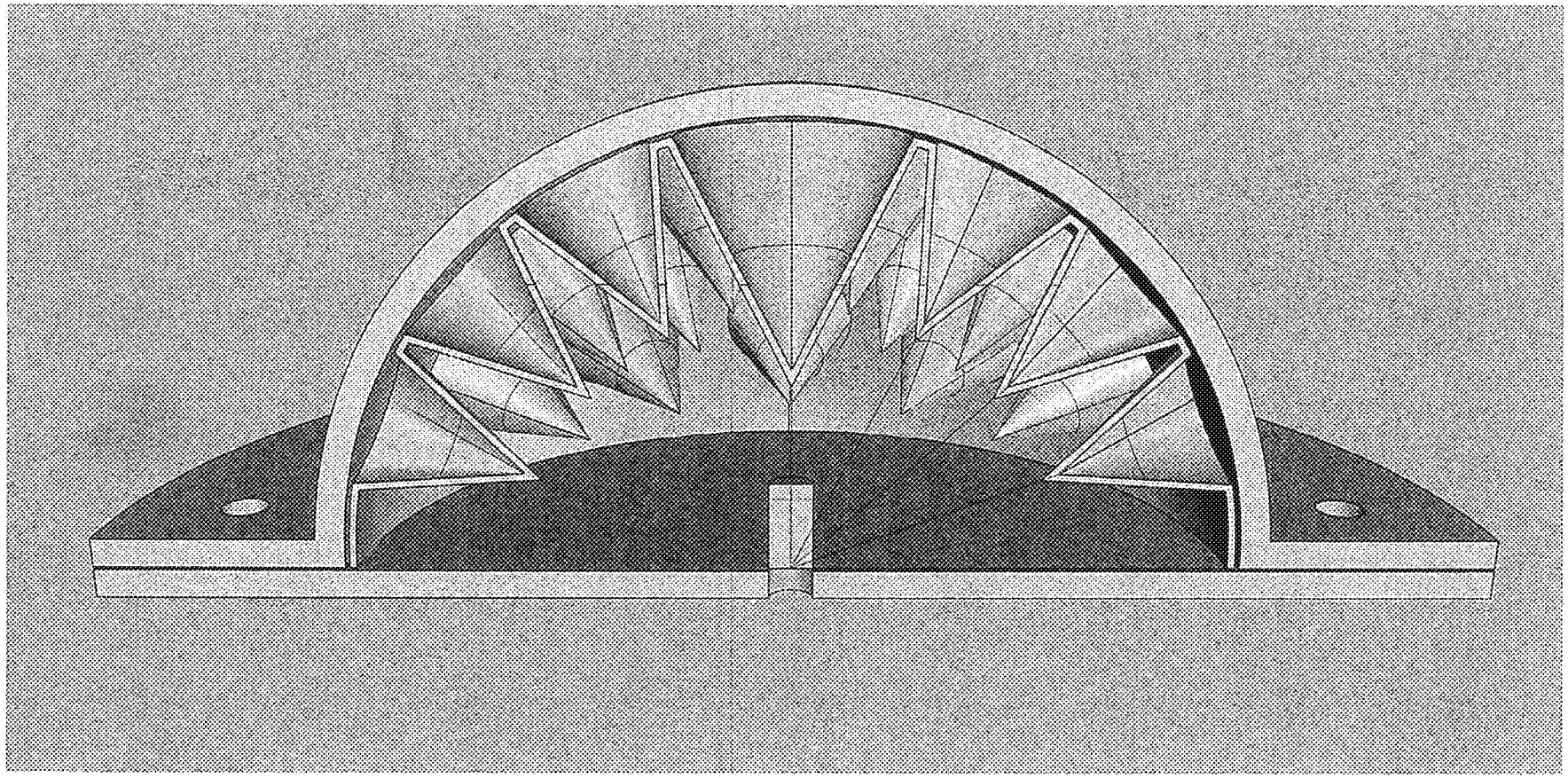
FIG. 19 shows the embodiment of FIG. 18 with the plates closed.

FIG. 19 shows the embodiment of FIG. 18 where the rigid outer shell 202 is bolted on to the underplate 204.

Figure 20:
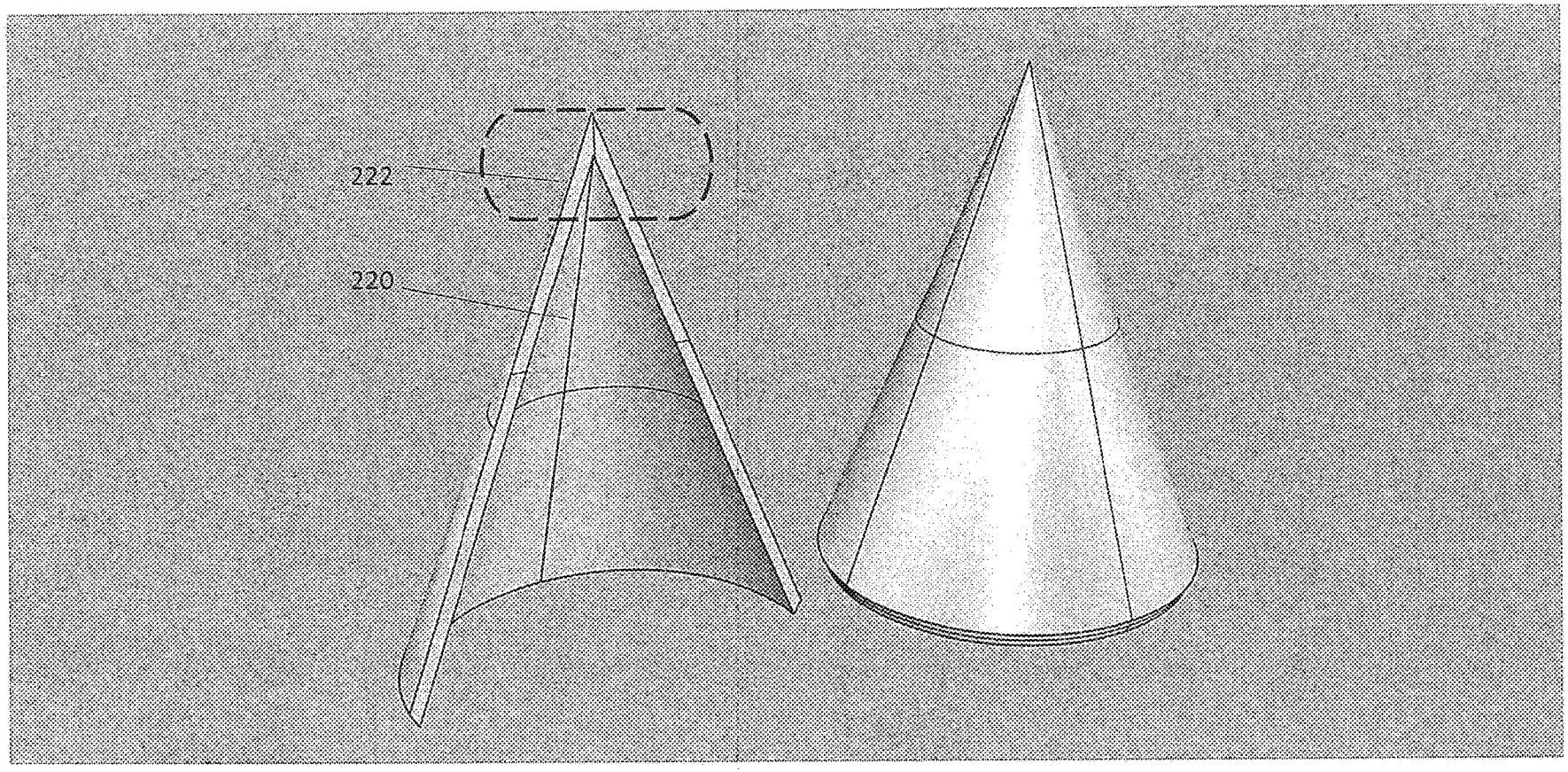
FIG. 20 shows an embodiment of the present invention in which a cone has a cutaway apex.

Reference is now made to FIG. 20, which shows a cone 220, and also shows a cross-section of the cone having a cutaway part 222 indicated by hashed lines. That is to say the cones may be open at the apex. For this and all other embodiments, the metal may be of variable thickness in order to provide desired characteristics to the jet, and also in order to change the rate of spread of the blast so that neighbouring cones may have different thicknesses to provide a focusing effect. In the case of the cone with the cutaway end, a jet is not fully formed and the impact changes the effect of the velocity of the fragments and the fragmentation pattern.

In another embodiment, the cone is a half cone, so that the cutaway diagram as shown has a flat wall against the open end. The effect is to provide a plane along which the blast wave may travel, and the half cone thus provides a guide for a desired wave pattern. It is further noted that the flat surface may include indentations, and the indentations may manipulate the blast wave in order to speed or slow down the propagation of the blast wave.

It is noted that there are two versions of the embodiment shown in FIG. 20. In one case the hollow reaches the apex but the liner ceases prior to the apex as illustrated. In the other case the liner ceases prior to the apex and there is explosive filling beyond the end of the liner. In yet other cases, the apex of the hollow may be plugged with an inert material such as plastic.

It is further noted that it is possible to change the location of the detonator relative to the various apexes of the different cones, in order to change the relative timings at which blast waves reach individual hollows. The location may be selected in order to focus the blast although care should be taken to ensure that the timing difference between neighbouring hollows is small. Too large a difference and the later to explode hollows may be destroyed before they have a chance to explode. In embodiments, a separate detonator may be provided for each hollow, or certain hollows may be grouped with detonators.

The radius of the base of the cone can be varied in order to give different properties to the jet. After manufacturing the cones they can be subjected to partial electroplating directed at particular locations on the cone, with materials that the cone is made of or other materials.

The hollows may be more frequent or larger in certain region and less frequent or smaller in other regions. Alternatively, the hollows may be more frequent or smaller in some regions and less frequent or larger in other regions. There may be some regions with no hollows at all.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the text is to be construed as if such a single embodiment is explicitly written out in detail. Conversely, various features of the invention, which are, for brevity, described in the context of a single embodiment, may also be provided separately or in any suitable subcombination or as suitable in any other described embodiment of the invention, and the text is to be construed as if such separate embodiments or subcombinations are explicitly set forth herein in detail.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

In addition, any priority document(s) of this application is/are hereby incorporated herein by reference in its/their entirety.

What is claimed is:

1. Device for producing focused explosions and generating high speed fragments and a blastwave, the device comprising:

a rigid outer shell, said rigid outer shell describing at least part of a sphere;

an explosive filling within said rigid outer shell, the explosive filling also describing at least part of a sphere and comprising a plurality of inwardly extending hollows, wherein said explosive filling is covered with an outer coating, said coating extending into said inwardly extending hollows; and a gap defined between the explosive filling and the rigid outer shell; and a hollow container for holding said explosive filling within said gap.

2. The device of claim 1, wherein said inwardly extending hollows are symmetrical along an axis extending into said explosive filling, and/or are cone-shaped.

3. The device of claim 2, wherein the inwardly-extending hollows have bases at the surface of the explosive filling, each base having a respective radius, wherein said gap is less than twice a size of the largest of said respective radii.

4. The device of claim 3, wherein said gap is larger than half the size of said largest radius, or larger than the size of said largest radius, or larger than one and a half times the size of said largest radius.

5. The device of claim 2 wherein the inwardly-extending hollows have bases at the surface of the explosive filling, each base having a respective radius, wherein said gap is at least twice a size of the largest of said respective radii.

6. The device of claim 1, wherein said outer coating comprises electroplating, and/or wherein said outer coating comprises one member of the group consisting of copper and aluminum and alloy.

7. The device of claim 1, wherein said rigid outer shell comprises one member of the group consisting of aluminium and metal and ceramics.

8. The device of claim 1, wherein said hollow container comprises openings.

9. The device of claim 8, wherein at least some of the openings comprise stepped edges and/or wherein said openings are of different sizes and/or comprising cones inserted into said openings.

10. The device of claim 1, wherein said hollow container comprises cone-shaped intrusions and/or wherein said cone-shaped intrusions intrude into said explosive filling to form a shaped charge.

11. The device of claim 1, wherein said rigid outer shell is grooved, and/or wherein the rigid outer shell comprises grooves on an outer surface, and/or wherein the rigid outer shell comprises grooves on an inner surface, and/or wherein a depth of a respective groove is selected in accordance with a size a nearby hollow, or wherein the rigid outer shell comprises ridges of substantially triangular cross-section.

12. The device of claim 1, further comprising a detonation point, the detonation point being equidistant from an apex of each one of said hollows, and/or the detonation point being angularly aligned with respective axes of symmetry of each of said hollows, and/or comprising a separate detonation point for each hollow.

13. A method of manufacturing a device for focused explosions with controlled fragmentation, the method comprising:

shaping an explosive charge with a plurality of hollows;

lining the explosive charge;

placing the explosive charge in a hollow container, the hollow container describing at least part of a sphere;

placing the hollow container in a rigid shell, the rigid shell also describing at least part of a sphere;

defining a gap between the container and the rigid shell, the gap extending between said hollow container and said rigid shell, the gap having a selected gap size, the gap size defining at least partly how an explosion at a given hollow impacts the rigid shell, thereby controlling fragmentation of said rigid shell.

14. The method of claim 13, wherein said hollows are cones, each cone having a radius at a surface of said explosive charge and an apex into said explosive charge.

15. The method of claim 14, comprising arranging said apexes to be equidistant from a detonation point located in said explosive charge.

16. The method of claim 14, comprising setting said gap size to be smaller than twice a largest cone radius.

17. The method of claim 13, comprising electroplating said hollows.

18. The method of claim 13, comprising forming said hollows by machining openings in said container, inserting cones and filling said explosive charge into said container between said cones.

19. The method of claim 18, comprising inserting cones into said hollows.

20. The method of claim 19, wherein a detonation at said detonation point is consequential on one member of the group consisting of a) another explosion, b) a remote detection of incoming ordnance, c) a radar detection of incoming ordnance, d) operation by a triggering screen, and e) impact on a metal plate.

21. The method of claim 13, comprising forming said hollows by machining into said explosive charge.

22. The method of claim 13, comprising:

placing a detonation point in said explosive charge;

making said hollows symmetrical along respective axes; and aligning said axes with said detonation point.

23. The method of claim 13, comprising placing a shock absorbent layer within the rigid shell.

24. Device for producing focused explosions, comprising:

a rigid outer shell, said rigid outer shell describing at least part of a sphere;

a hollow container under said rigid outer shell;

an explosive filling, the explosive filling placed within said hollow container, the explosive filling comprising a plurality of hollows, the hollows being lined with a coating, the coating comprising one member of the group consisting of copper and aluminum and alloys extending inwardly along respective axes towards an apex, the explosive filling being placed such that a gap is defined between said hollow container and said rigid outer shell, the gap extending under said rigid outer shell; and at least one detonation point within said explosive filling, each axis and corresponding apex being aligned with at least one said detonation point.

* * * * *